US008608240B2

(12) United States Patent
Marshall et al.

(10) Patent No.: US 8,608,240 B2
(45) Date of Patent: Dec. 17, 2013

(54) MECHANISM AND CHAIR FOR POWERED COMBINED AND INDEPENDENT SEAT BACK AND LEG REST MOTION

(75) Inventors: Richard E. Marshall, Monroe, MI (US); Eugene Cole, II, Maumee, OH (US); Larry P. LaPointe, Temperance, MI (US); Chad E. Adams, Perrysburg, OH (US)

(73) Assignee: La-Z-Boy Incorporated, Monroe, MI (US)

( * ) Notice: Subject to any disclaimer, the term of this patent is extended or adjusted under 35 U.S.C. 154(b) by 200 days.

(21) Appl. No.: 13/229,149

(22) Filed: Sep. 9, 2011

(65) Prior Publication Data

US 2013/0062914 A1 Mar. 14, 2013

(51) Int. Cl.
*A47C 1/022* (2006.01)

(52) U.S. Cl.
USPC ..... 297/69; 297/89; 297/91

(58) Field of Classification Search
USPC ..... 297/9, 88, 89, 90, 916
See application file for complete search history.

(56) References Cited

U.S. PATENT DOCUMENTS

| | | | | |
|---|---|---|---|---|
| 3,138,402 | A | 6/1964 | Heyl, Jr. et al. | |
| 3,338,632 | A | 8/1967 | Kleinsorge | |
| 3,343,871 | A | 9/1967 | Yates et al. | |
| 3,588,170 | A | 6/1971 | Knabusch et al. | |
| 4,007,960 | A | 2/1977 | Gaffney | |
| 4,386,803 | A * | 6/1983 | Gilderbloom | 297/84 |
| 4,637,652 | A | 1/1987 | Bergenwall | |
| 4,722,566 | A | 2/1988 | Castellini | |
| 4,852,939 | A | 8/1989 | Krauska | |
| 4,993,777 | A | 2/1991 | LaPointe | |
| 5,024,486 | A | 6/1991 | Auel | |
| 5,061,010 | A | 10/1991 | LaPointe | |
| 5,165,753 | A | 11/1992 | Henderson | |
| 5,215,351 | A | 6/1993 | LaPointe | |
| 5,288,126 | A | 2/1994 | Saul et al. | |
| 5,312,153 | A | 5/1994 | Lin | |

(Continued)

FOREIGN PATENT DOCUMENTS

| | | |
|---|---|---|
| DE | 29812763 | 9/1998 |
| EP | 0218502 | 4/1987 |

(Continued)

OTHER PUBLICATIONS

International Search Report for International Application No. PCT/US2012/052090 mailed Nov. 28, 2012.

(Continued)

*Primary Examiner* — Sarah B McPartlin

(57) ABSTRACT

A furniture member mechanism includes a first actuator device electrically operated to displace first and second seat back actuation links connected to and operating to rotate a seat back member between upright and fully reclined positions. A pantograph linkage set connected to a leg rest member is at least partially supported in an extended position by rotational contact with a support rod. A second actuator device identical to the first actuator device is electrically operated to axially rotate a drive rod connected to a drive link. The drive link is connected to and displaces the pantograph linkage set between the stowed and extended positions. A swing lever rotatably connected to the support rod is rotated during operation of the second actuator device to extend the pantograph linkage set. The swing lever in a fully rotated position displaces the support rod creating a furniture member tilt position.

29 Claims, 15 Drawing Sheets

(56) References Cited

U.S. PATENT DOCUMENTS

| | | | | |
|---|---|---|---|---|
| 5,314,238 | A | 5/1994 | Komorowski et al. | |
| 5,366,036 | A * | 11/1994 | Perry | 180/65.1 |
| 5,466,046 | A | 11/1995 | Komorowski et al. | |
| 5,482,350 | A | 1/1996 | Komorowski et al. | |
| 5,651,580 | A | 7/1997 | LaPointe et al. | |
| 5,730,494 | A | 3/1998 | LaPointe et al. | |
| 5,747,965 | A | 5/1998 | LaPointe et al. | |
| 5,806,920 | A | 9/1998 | Blount | |
| 5,823,621 | A | 10/1998 | Broadhead | |
| 5,992,931 | A | 11/1999 | LaPointe et al. | |
| 6,557,934 | B2 * | 5/2003 | Wiecek | 297/84 |
| 6,557,940 | B2 | 5/2003 | Hayashi et al. | |
| 6,871,910 | B2 | 3/2005 | Hale | |
| 6,893,085 | B2 | 5/2005 | LaPointe et al. | |
| 6,896,323 | B2 | 5/2005 | LaPointe et al. | |
| 6,974,186 | B1 * | 12/2005 | Chang | 297/68 |
| 7,090,297 | B2 | 8/2006 | Mohn et al. | |
| 7,628,452 | B2 * | 12/2009 | Du et al. | 297/259.2 |
| 7,673,933 | B2 * | 3/2010 | Lawson | 297/69 |
| 7,735,912 | B2 * | 6/2010 | Robertson | 297/85 M |
| 7,828,756 | B2 | 11/2010 | Kamba | |
| 8,403,409 | B2 * | 3/2013 | Pollard et al. | 297/85 M |
| 2002/0125751 | A1 | 9/2002 | Bullard | |
| 2005/0035632 | A1 | 2/2005 | Tseng | |
| 2007/0132292 | A1 | 6/2007 | Robertson | |

FOREIGN PATENT DOCUMENTS

| | | |
|---|---|---|
| GB | 1123441 | 8/1968 |
| GB | 1497973 | 1/1978 |
| GB | 2380399 | 4/2003 |
| GB | 2436474 | 9/2007 |
| GB | 2436475 | 9/2007 |
| GB | 2436749 | 10/2007 |

OTHER PUBLICATIONS

Written Opinion of the International Searching Authority for International Application No. PCT/US2012/052090 mailed Nov. 28, 2012.

* cited by examiner

FIG 8
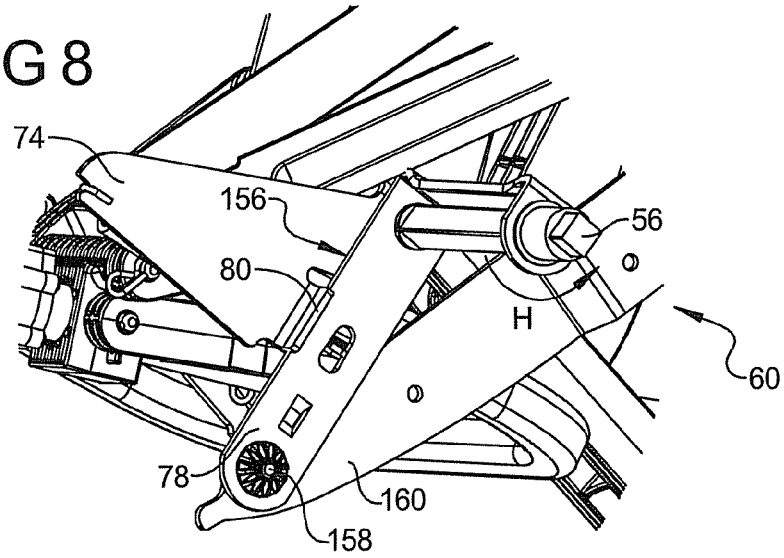
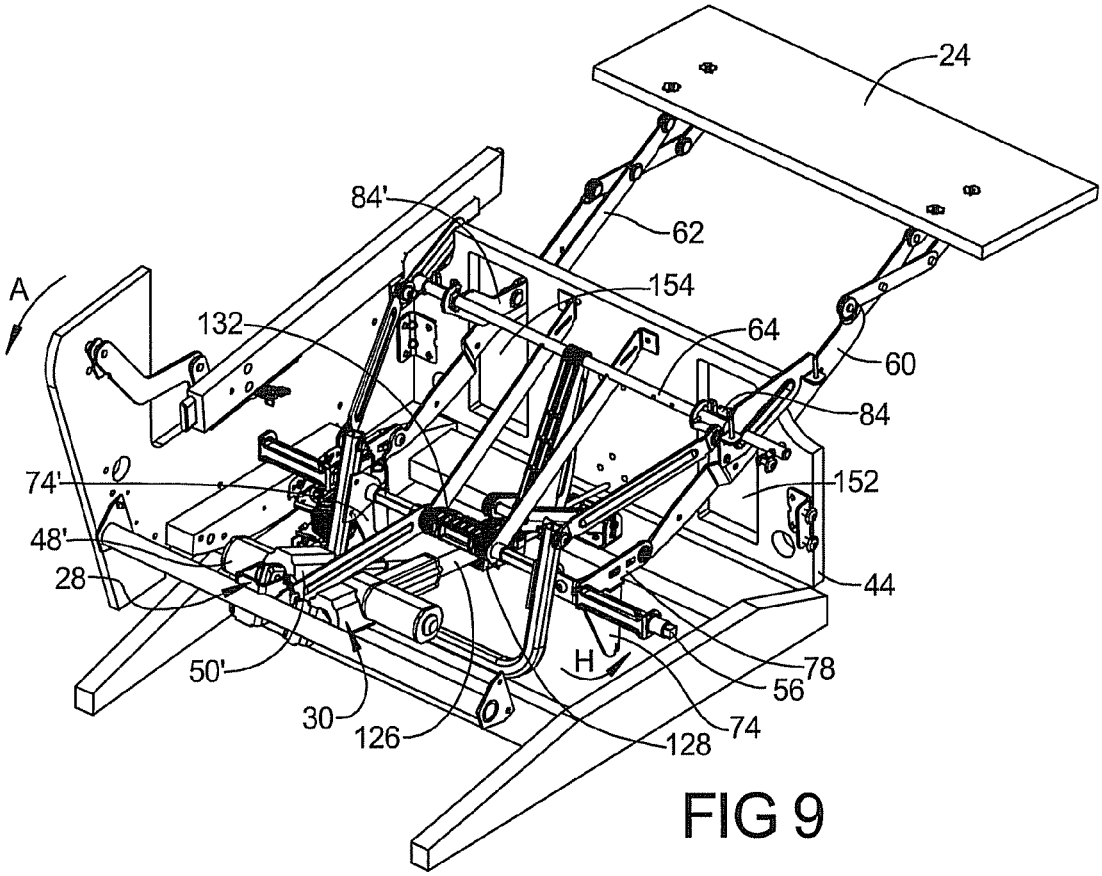
FIG 9

FIG 10
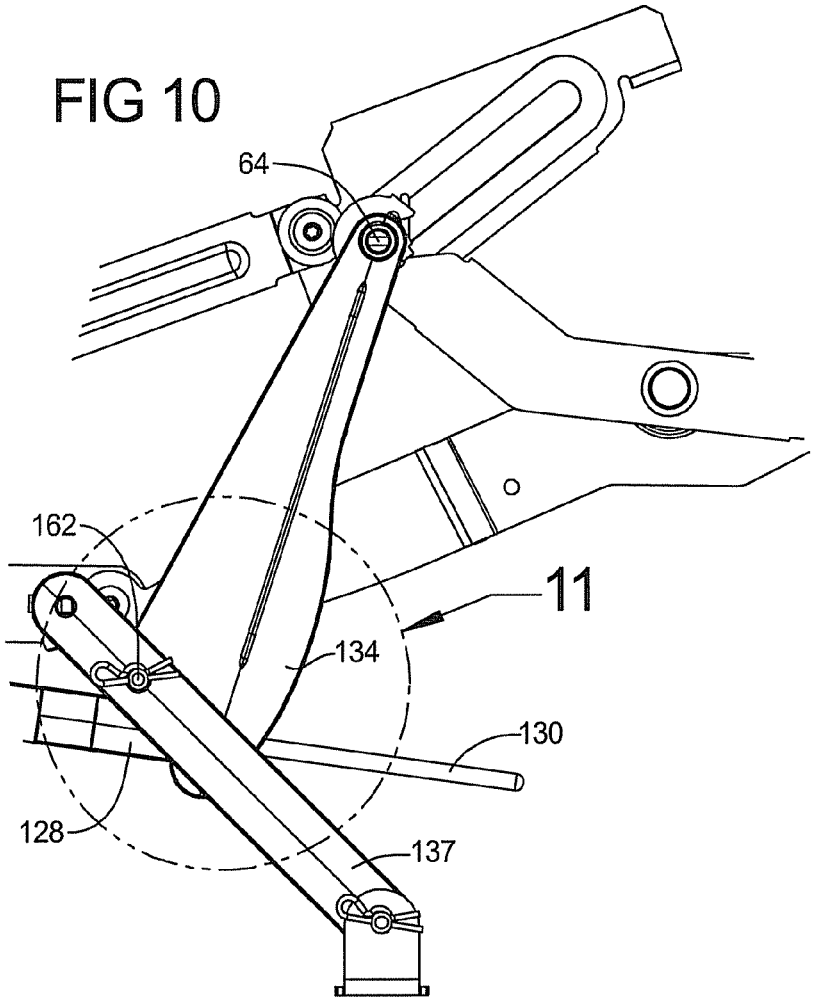
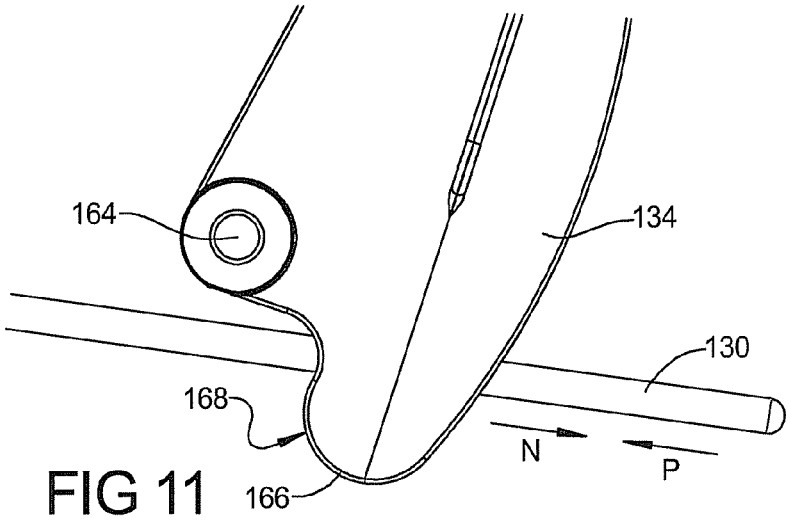
FIG 11

MECHANISM AND CHAIR FOR POWERED COMBINED AND INDEPENDENT SEAT BACK AND LEG REST MOTION

FIELD

The present disclosure relates to a furniture member mechanism providing for power combined or independent seat back and leg rest motions.

BACKGROUND

This section provides background information related to the present disclosure which is not necessarily prior art.

Furniture members such as chairs, sofas, loveseats, sectionals, and the like commonly include a mechanism that permits the occupant of the furniture member to manually move a leg rest member from a stowed to an extended position to support the legs of the occupant. Occupant supplied weight/force is commonly required in these furniture members to rotate a seat back member between an upright and a fully reclined position, independent of the mechanism operation moving the leg rest member. Power actuators are also known which provide for powered or automatic operation of a leg rest member followed sequentially by powered operation of a seat back member. These designs commonly require the leg rest member to extend first followed by rotation of the seat back member. To reverse the furniture member position, the power actuator is operated to rotate the seat back member forward followed sequentially by retraction of the leg rest member. Independent operation of the leg rest member and seat back member are typically not provided in these designs.

SUMMARY

This section provides a general summary of the disclosure, and is not a comprehensive disclosure of its full scope or all of its features.

According to several embodiments, a furniture member mechanism for power combined and independent seat back and leg rest motion includes a first actuator device connected to and electrically operated to displace a seat back member between an upright position and a fully reclined position. A second actuator device is connected to and electrically operated to displace a leg rest member between a stowed and a fully extended position. The mechanism is selectively operated either having one of the first and second actuator devices energized while the other one of the first and second actuator devices is de-energized, or having both the first and second actuator devices energized simultaneously.

According to further embodiments, a furniture member mechanism for power combined and independent seat back and leg rest motion includes a first actuator device electrically operated to displace first and second seat back actuation links connected to and operating to rotate a seat back member between an upright position and a fully reclined position. A second actuator device is electrically operated to rotate at least one drive link connected to and displacing a leg rest member between a stowed and a fully extended position. The mechanism is selectively operated having one of the first and second actuator devices energized while the other one of the first and second actuator devices is de-energized, or having both the first and second actuator devices energized simultaneously.

According to other embodiments, a furniture member mechanism includes a first actuator device electrically operated to displace first and second seat back actuation links connected to and operating to rotate a seat back member between upright and fully reclined positions. A pantograph linkage set connected to a leg rest member is at least partially supported in an extended position by rotational contact with a support rod. A second actuator device identical to the first actuator device is electrically operated to axially rotate a drive rod connected to a drive link. The drive link is connected to and displaces the pantograph linkage set between the stowed and extended positions. A swing lever rotatably connected to the support rod is rotated during operation of the second actuator device to extend the pantograph linkage set. The swing lever in a fully rotated position displaces the support rod creating a furniture member tilt position.

According to still further embodiments, a furniture member includes a furniture frame assembly rotatably connected to a base member. A rocker spring assembly is connected to each of the furniture frame assembly and the base member permitting a rocking motion of the furniture frame assembly with respect to the base member. A mechanism includes a first actuator device electrically operated to displace first and second seat back actuation links connected to and operating to rotate a seat back member between an upright position and a fully reclined position. A pantograph linkage set is connected to a leg rest member. The pantograph linkage set is at least partially supported in an extended position by rotational contact with a support rod. The support rod is connected to opposite first and second side members of the furniture frame assembly. A second actuator device identical to the first actuator device is electrically operated to axially rotate a drive rod connected to at least one drive link, the drive link connected to and displacing the pantograph linkage set between a stowed and the extended positions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 8 is a right rear perspective view of a drive and swing link portion of the mechanism operated to control leg rest member rotation;

FIG. 9 is a right rear perspective view of a portion of the furniture member of FIG. 1 showing components operated to control leg rest member rotation;

FIG. 10 is a right side elevational view of a portion of the mechanism of FIG. 6;

FIG. 11 is a right side elevational view of area 11 of FIG. 10 having the tilt swing lever removed for clarity;

Corresponding reference numerals indicate corresponding parts throughout the several views of the drawings.

DETAILED DESCRIPTION

Example embodiments will now be described more fully with reference to the accompanying drawings.

Figure 1:
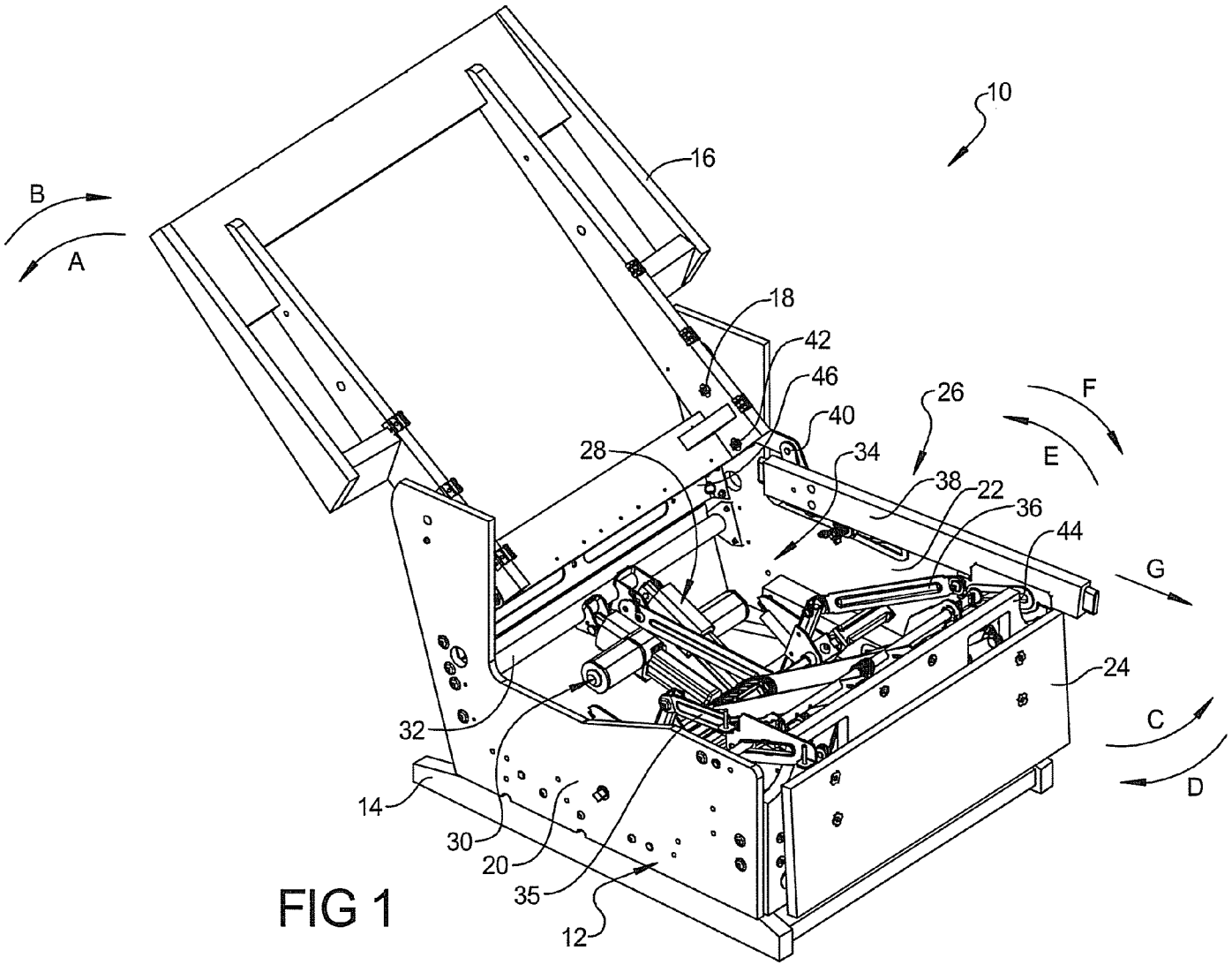
FIG. 1 is a front right perspective view of a furniture member having a mechanism for powered combined or independent operation of a leg rest member and a seat back member.

Referring to FIG. 1, a furniture member 10 includes a furniture frame assembly 12 which is rotatably supported with respect to a base member 14. A seat back member 16 is rotatably connected to furniture frame assembly 12 and can rotate from a fully upright position in a seat back recline direction "A" or return from a fully reclined position in a seat back return direction "B" toward the fully upright position, or be positioned at any position therebetween. Seat back member 16 is rotatably connected to furniture frame assembly 12 using oppositely positioned rotational connectors 18 (only one of which is clearly visible in this view). Furniture frame assembly 12 includes a first side member 20 positioned with respect to an occupant's right hand side for an occupant seated on furniture member 10, and a second side member 22 positioned on the occupant's left hand side. A leg rest member 24 is extensible from a fully stowed position shown in a leg rest extension direction "C" and returnable in a leg rest retraction direction "D" using a mechanism 26 which is connected to each of the furniture frame assembly 12 and base member 14. Movement of the seat back member 16 is also controlled at least in the seat back recline direction "A" by operation of mechanism 26.

Mechanism 26 includes each of a first actuator device 28 which is used to control rotation of the seat back member 16, and a second actuator device 30 which is used to extend or retract leg rest member 24 as well as to permit a tilting motion of furniture frame assembly 12 with respect to base member 14. The tilting motion of furniture frame assembly 12 is with respect to a rear rotation direction "E" and a forward rotation direction "F". Operation of second actuator device 30 simultaneously controls displacement of leg rest member 24 as well as tilt rotation of furniture frame assembly 12. For example, as leg rest member 24 is extended in the leg rest extension direction "C", furniture frame assembly 12 is tilted by rotation in the rear rotation direction "E". Opposite rotation of leg rest member 24 also causes an opposite rotation of furniture frame assembly 12 in the forward rotation direction "F".

First and second actuator devices 28, 30 are identical to each other, and each is rotatably connected to a rigid tube 32. Rigid tube 32 is fixedly connected to each of the first and second side members 20, 22 to prevent axial rotation of rigid tube 32. This provides a fixed reference point for operation of either of the first or second actuator devices 28, 30. First actuator device 28 is connected to and operates a seat back operating portion 34 of mechanism 26. Seat back operating portion 34 includes each of a first seat back actuation link 35 positioned proximate to first side member 20 and a second seat back actuation link 36 positioned proximate to second side member 22. A lateral drive member 38, which according to several embodiments is a length of wood material, but can be any suitable material such as metal or plastic, is movably connected with respect to second side member 22 and connected by a seat back linkage set 40 to seat back member 16. Displacement of lateral drive member 38 in a drive member powered motion direction "G" by operation of first actuator device 28 causes a reclining rotation of seat back member 16 in the seat back recline direction "A". To provide for rotation of seat back member 16, a rotational fastener 42 is used to rotatably connect seat back linkage set 40 to seat back member 16. To structurally stiffen furniture frame assembly 12, a forward frame member 44 is oriented substantially perpendicular to and is fixedly connected to each of the first and second side members 20, 22. A frame brace 46, which is positioned in an orientation substantially parallel with respect to rigid tube 32 can also be provided, which is also fixedly connected to each of the first and second side members 20, 22.

Figure 2:
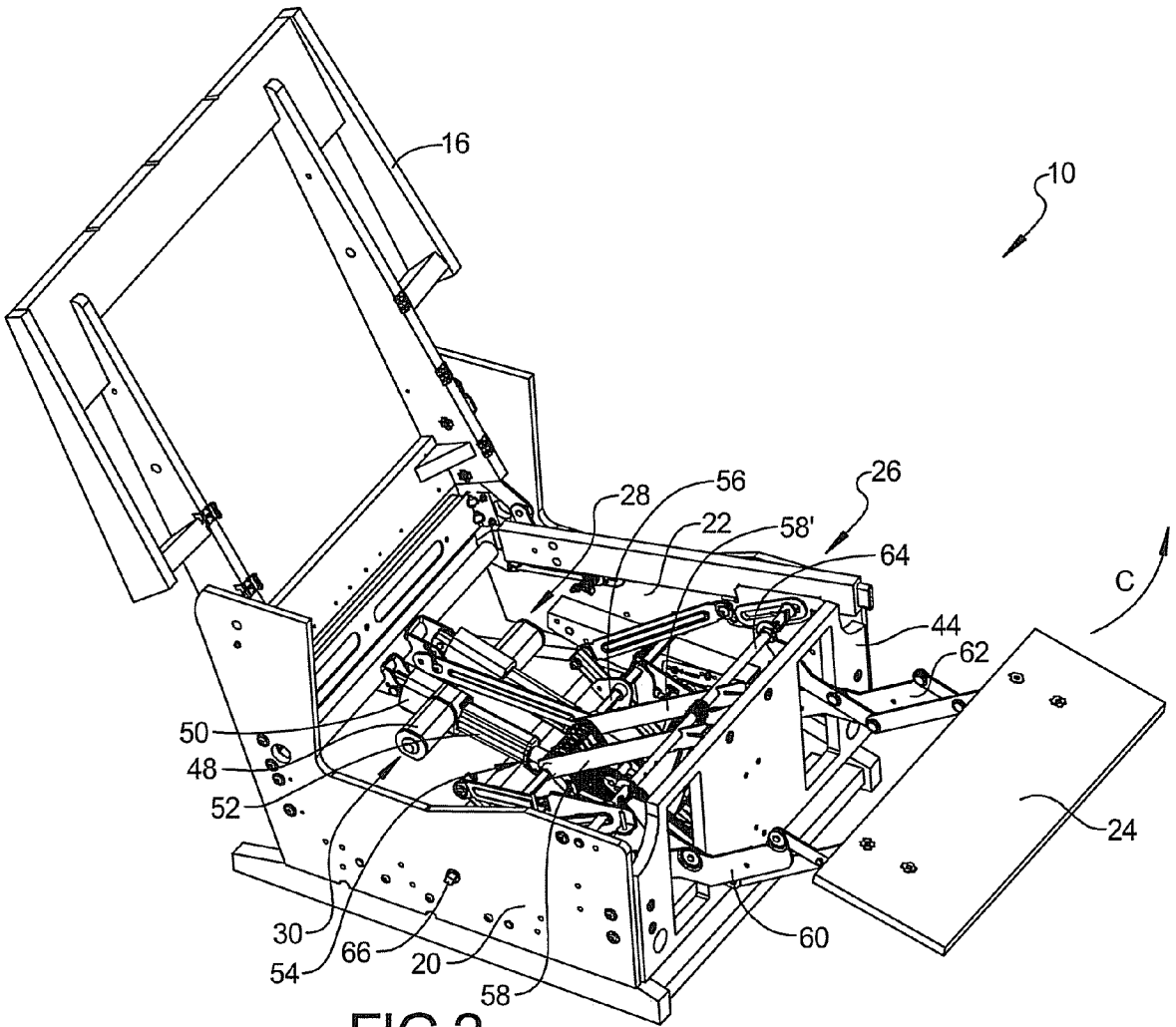
FIG. 2 is a right front perspective view of the furniture member of FIG. 1 showing the leg rest member in a fully extended position.

Referring to FIG. 2, each of the first and second actuator devices 28, 30 include an actuator motor 48, 48' which is connected to and provides energy of operation for an actuator drive member 50, 50'. According to several embodiments, actuator motor 48, 48' for each of the first and second actuator devices 28, 30 is operated using a 24-volt DC current. According to several embodiments, a rotary motion of actuator motor 48, 48' is converted to a linear motion by actuator drive member 50, 50', for example using a gear such as a worm gear (not shown). An actuator displacement member 52 is connected to and linearly displaced by actuator drive member 50 and provides for opposing linear motions. Similar to seat back operating portion 34 which is connected to first actuator device 28, second actuator device 30 has a leg rest and tilt operating portion 54 which converts the fore and aft sliding displacement of the actuator displacement member 52 into an axial rotation of a drive rod 56 which is supported by both first and second side members 20, 22 as well as further components, which will be described in greater detail herein. Included with these further support components are drive rod stiffening braces 58, 58' which are connected to drive rod 56, permitting axial rotation of drive rod 56 while providing lateral support by connection of the drive rod stiffening braces 58, 58' to forward frame member 44. Drive rod stiffening braces 58, 58' therefore permit axial rotation of drive rod 56 while limiting or preventing longitudinal bending of drive rod 56. Axial rotation of drive rod 56 displaces both first and second pantograph linkage sets 60, 62 in the leg rest extension direction "C" which is fixedly connected to leg rest member 24.

To provide additional occupant weight support for the weight of the occupant's legs on leg rest member 24, mechanism 26 further includes a support rod 64 which is oriented substantially parallel to drive rod 56 and is positioned forward of drive rod 56 to provide additional support for first and second pantograph linkage sets 60, 62 in their extended positions. Support rod 64 does not axially rotate but is supported at opposite ends by first and second side members 20, 22. According to several embodiments, a drive rod free end 66 of drive rod 56 can extend partially outward with respect to first side member 20. Drive rod free end 66 can be provided for attachment of a lever (not shown) used for manual rotation of drive rod 56 when electrical power is not available for operation of the second actuator device 30.

Figure 3:
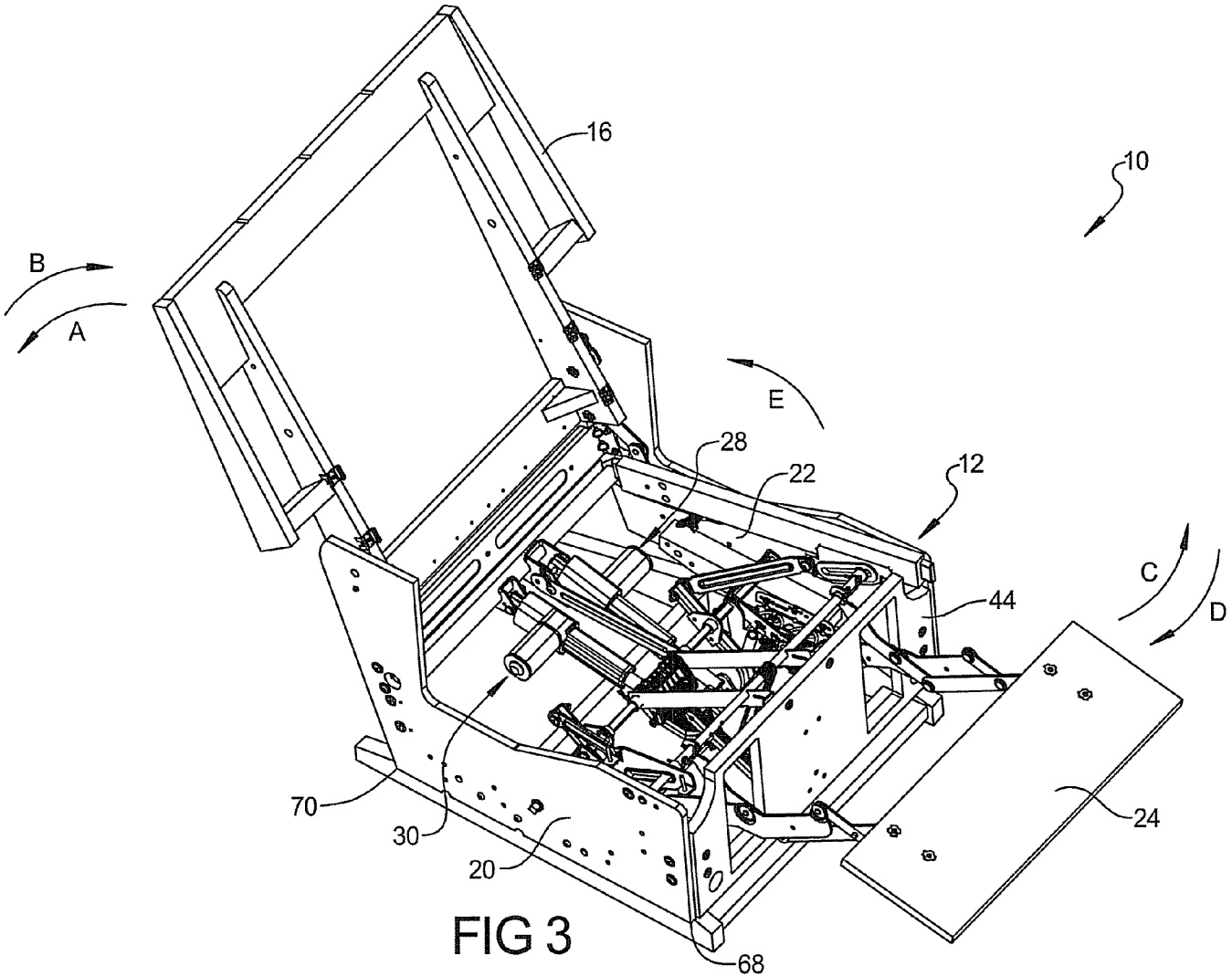
FIG. 3 is right front perspective view of the furniture member of FIG. 1 showing the leg rest member in a fully extended position and the seat back member in a fully reclined position.

Referring to FIG. 3, furniture member 10 can be positioned having the seat back member 16 in the fully reclined position simultaneously with the leg rest member 24 being moved to the fully extended position by simultaneous operation of both the first and second actuator devices 28, 30. As previously noted, as the leg rest member 24 extends in the leg rest extension direction "C", furniture frame assembly 12 is tilted rearwardly with respect to the rear rotation direction "E". In a furniture member frame tilt position, a frame assembly front corner 68 is elevated with respect to a frame assembly rear corner 70 of furniture frame assembly 12 when the leg rest member 24 is in any extended position with respect to forward frame member 44. Mechanism 26 of furniture member 10 can also be operated by energizing only one of the first or second actuator devices 28, 30 independently of the other, to either rotate seat back member 16 or extend leg rest member 24.

Furniture member 10 further provides the option for the operator to return the seat back member 16 to the fully upright position by independent powered operation of first actuator device 28, causing seat back member 16 to rotate in the seat back return direction "B" while the leg rest member 24 is still in any extended position. Conversely, the operator can also return the leg rest member 24 from any extended position to the fully stowed or retracted position by movement in the leg rest retraction direction "D" by independent operation of second actuator device 30, while the seat back member 16 is retained in the upright or any reclined position. This optional operation of either the seat back member 16 or the leg rest member 24 is permitted by the independent connection and operation of the first and second actuator devices 28, 30.

Figure 4:
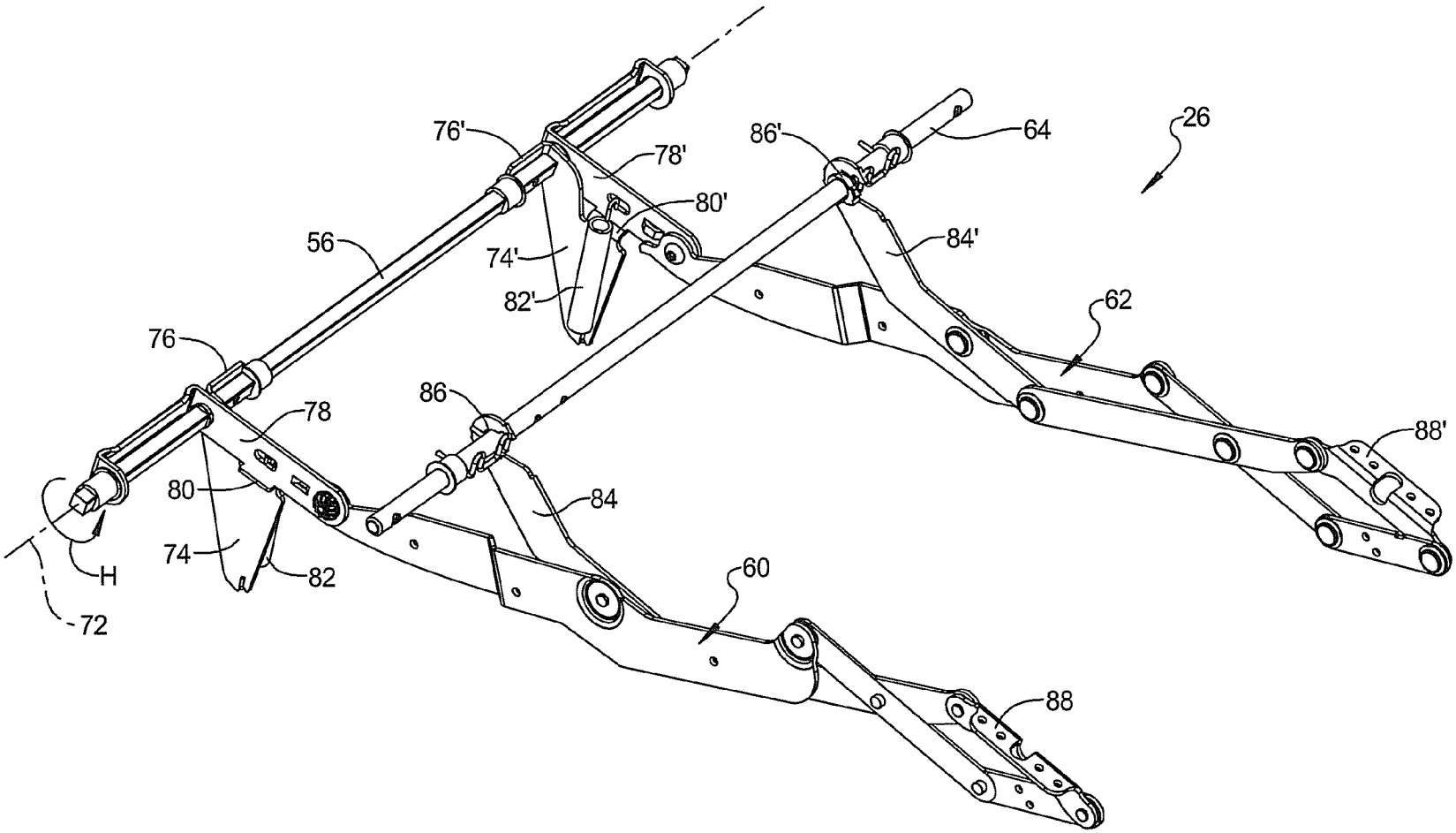
FIG. 4 is a right front perspective view of an extended pantograph linkage set of the mechanism of FIG. 1 connected to both a drive rod and a support shaft.

Referring to FIG. 4, features relating to the drive rod 56, support rod 64, and each of the first and second pantograph linkage sets 60, 62 are shown in greater detail, having the first and second pantograph linkage sets 60, 62 in their fully extended positions. To extend the first and second pantograph linkage sets 60, 62, drive rod 56 is rotated in a first drive rod rotation direction "H" which is counterclockwise as viewed in FIG. 4. This counterclockwise rotation of drive rod 56 is caused by a counterclockwise rotation of first and second leg rest drive links 74, 74'. It is noted that each of the components connected to and operating the first and second pantograph linkage sets 60, 62 are substantially opposite and mirror image configurations of each other; therefore, the following discussion of the connections and operation of first pantograph linkage set 60 applies equally to second pantograph linkage set 62. The first leg rest drive link 74 is substantially triangular shaped and includes a drive link flange 76 which is fixedly connected to drive rod 56. Axial rotation of drive rod 56 therefore co-rotates the leg rest drive link 74. Rotation of first leg rest drive link 74 in the first drive rod rotation direction "H" also co-rotates a swing link 78 which is rotatably connected to first pantograph linkage set 60. It should be evident that an opposite axial rotation of drive rod 56 in a clockwise rotation direction will cause retraction of the first and second pantograph linkage sets 60, 62.

A contact flange 80 of leg rest drive link 74, which is oriented substantially perpendicular to a triangular shaped body of first leg rest drive link 74, directly contacts swing link 78 to cause rotation of swing link 78 thereby matching the first drive rod rotation direction "H". Swing link 78 is not directly connected to first leg rest drive link 74, but is induced to rotate when pushed by contact flange 80. Contact between swing link 78 and first leg rest drive link 74 is normally maintained by a biasing force created by a biasing member 82 which is connected to both first leg rest drive link 74 and swing link 78. Swing link 78 is rotatably connected to drive rod 56, and is therefore permitted to freely rotate with respect to drive rod 56.

A pantograph connecting link 84 is rotatably connected to first pantograph linkage set 60 and rotatably connected to support rod 64. The weight of the occupant's legs carried by the leg rest member (not shown in this view) is therefore distributed through both swing link 78 and pantograph connecting link 84. This distributes the occupant's leg weight to each of the drive rod 56 and the support rod 64. First pantograph linkage set 60 further includes a leg rest rotational fitting 86 acting as a bearing to permit reduced friction rotation of pantograph connecting link 84 with respect to support rod 64. A leg rest connecting flange 88 is provided at a free end of first pantograph linkage set 60 which is used as a mounting surface for leg rest member 24 shown and described in reference to FIG. 1.

Figure 5:
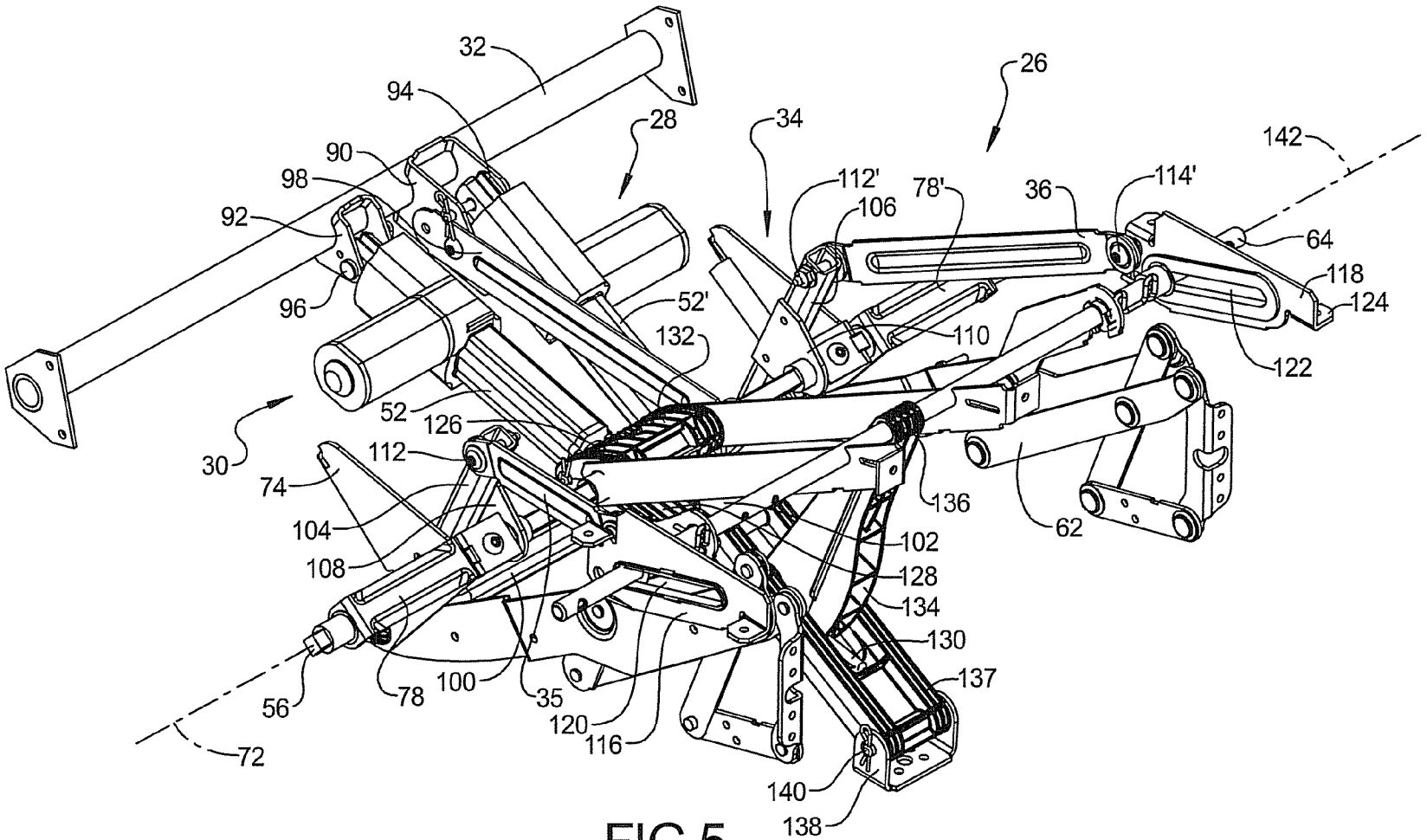
FIG. 5 is a right front perspective view of a portion of the mechanism of FIG. 1.

Referring to FIG. 5, the first and second actuator devices 28, 30 are individually rotatably connected to rigid tube 32 using either a first actuator mount bracket 90 or a second actuator mount bracket 92. A first actuator mount pin 94 permits first actuator device 28 to rotate with respect to first actuator mount bracket 90. Similarly, a second actuator mount pin 96 permits second actuator device 30 to rotate with respect to second actuator mount bracket 92. According to several embodiments, a drive rod support brace 98 is connected to first actuator mount bracket 90 and also to drive rod 56 to provide additional support for drive rod 56.

Further components of seat back operating portion 34 include a swing connection tube 100 which is substantially U-shaped and is freely rotatably supported on drive rod 56. Swing connection tube 100 is rotated by extension or retraction of a first actuator extension shaft 102, which is extendable or retractable from actuator displacement member 52' during operation of first actuator device 28. Swing connection tube 100 includes a first tube arm 104 oriented substantially parallel with respect to a second tube arm 106. First tube arm 104 is rotatably connected to drive rod 56 using a first arm bracket 108. Similarly, second tube arm 106 is rotatably connected to drive rod 56 using a second arm bracket 110. First seat back actuation link 35 is rotatably connected to first tube arm 104 using a first spin fitting 112. Similarly, a second spin fitting 114 is used to rotatably connect second seat back actuation link 36 to second tube arm 106. Rotation of swing connection tube 100 with respect to drive rod axis of rotation 72 therefore displaces first and second seat back actuation links 35, 36 which are individually connected to and displace each of a first mount plate 116 and a second mount plate 118. First mount plate 116 includes an elongated slot 120 which slidably receives support rod 64. Similarly, second mount plate 118 includes an elongated slot 122 to also slidably receive support rod 64. Support rod 64 can therefore be substantially fixed in position with respect to drive rod 56 even as the first and second mount plates 116, 118 are displaced in either a forward or a rearward direction by rotation of swing connection tube 100.

With continuing reference to FIGS. 5 and 1, the lateral drive member 38 is fixed to a plate flange 124 extending from first mount plate 116. The displacement of second mount plate 118 in a forward or rearward direction by rotation of swing connection tube 100 therefore longitudinally displaces lateral drive member 38, which thereby rotates the seat back member 16 via seat back linkage set 40. Support rod 64, which is fixed in position, extends through the individual elongated slots 120, 122. A length of each of the elongated slots 120, 122 is therefore predetermined to accommodate the total forward or rearward displacement of the first or second mount plates 116, 118.

The second actuator device 30 further includes a second actuator extension shaft 126 which extends in a forward or rearward general direction by operation of second actuator device 30. Second actuator extension shaft 126 is connected to a drive toggle connector 128. Drive toggle connector 128 is connected to a drive toggle connector extension rod 130 such that drive toggle connector extension rod 130 is co-linearly displaced during displacement of drive toggle connector 128. A drive toggle 132 is connected to drive rod 56 and rotatably connected to drive toggle connector 128. Extension of drive toggle connector 128 during extension or retraction of second actuator extension shaft 126 rotates drive toggle 132, thereby axially rotating drive rod 56. Because drive rod 56 is substantially square or rectangular in cross-sectional shape, the geometry of the connectors used between drive toggle 132 and drive rod 56 are also square or rectangular in shape, matching the geometry of drive rod 56.

A swing lever 134 is rotatably connected to support rod 64 at a swing lever rotation end 136 such that swing lever 134 is freely rotatable with respect to support rod 64. During powered operation of second actuator device 30, drive toggle connector 128 contacts swing lever 134 and thereby rotates swing lever 134 with respect to support rod 64. A tilt swing lever 137 is connected to base member 14 using a tilt swing mount bracket 138 and a tilt swing rotation pin 140. Tilt swing lever 137 is rotatably connected to swing lever 134. Rotation of swing lever 134 causes an oppositely directed rotation of tilt swing lever 137. A force exerted by drive toggle connector 128 to swing lever 134 and tilt swing lever 137 causes furniture frame assembly 12 to rotate (tilt) during extension of the leg rest assembly (only partially shown with respect to second pantograph linkage set 62). Because support rod 64 is substantially fixed in position with respect to furniture frame assembly 12, as the combination of swing lever 134 and tilt swing lever 137 rotate by displacement of drive toggle connector 128, the tilt swing lever 137 and the swing lever 134 will rotate into a substantially co-linear orientation as will be described in greater detail in reference to FIGS. 16 and 17. This linear alignment creates a lifting force pushing upwardly and forwardly on support rod 64, causing rear rotation or tilt of furniture frame assembly 12.

Operation of first actuator device 28 causes rotation of swing connection tube 100 to displace the first and second mount plates 116, 118 but causes no axial rotation of drive rod 56. Rotation of drive rod 56 only occurs during operation of second actuator device 30 to both extend the first and second pantograph linkage sets 60, 62 and to produce the rearward tilt of furniture frame assembly 12. The support rod 64 is not axially rotatable with respect to a support rod longitudinal axis 142 however support rod 64 is displaceable by the rotation of swing lever 134 and tilt swing lever 137 to produce the rearward tilt of furniture frame assembly 12.

Figure 6:
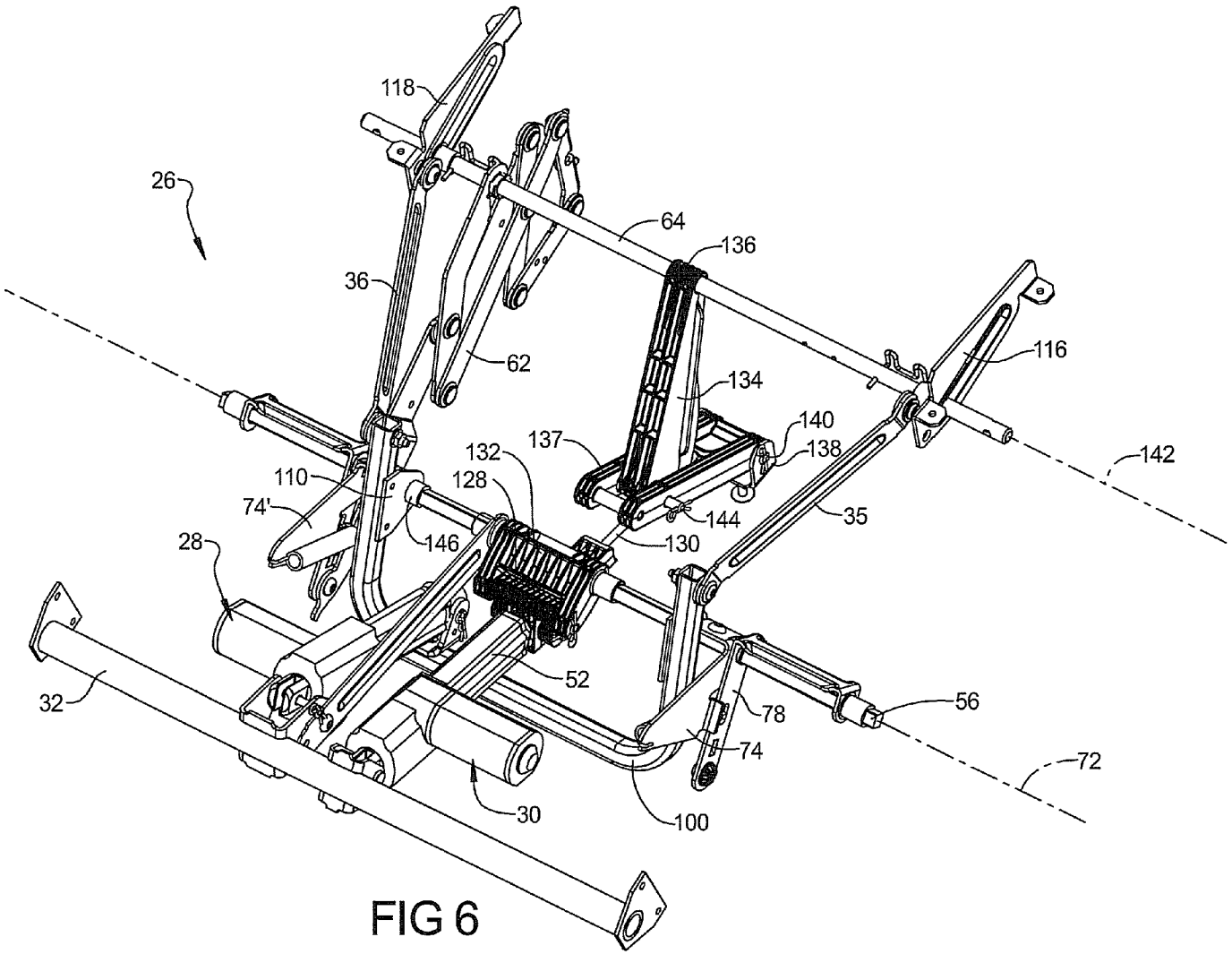
FIG. 6 is a right rear perspective view of the mechanism of FIG. 5.

Referring to FIG. 6, the distinct operational portions of mechanism 26 for controlling seat back rotation or leg rest and tilt movement are more clearly visible by removal of the furniture frame assembly 12. First actuator device 28 operates to rotate swing connection tube 100 which forwardly displaces each of the first and second seat back actuation links 35, 36. Forward displacement of the first and second seat back actuation links 35, 36, in turn, forwardly and upwardly displace the first and second mount plates 116, 118. Reversing the operation of first actuator device 28 reverses the rotation of swing connection tube 100, thereby retracting the first and second seat back actuation links 35, 36 and second mount plates 116, 118. As previously noted, the forward or rearward displacements of first or second mount plates 116, 118 occur independently of support rod 64 such that support rod 64 remains in position with respect to support rod longitudinal axis 142 during the displacement of first or second mount plates 116, 118.

With continuing reference to FIGS. 6 and 1-3, independent operation of second actuator device 30 displaces the actuator displacement member 52 thereby rotating drive toggle connector 128 and drive toggle 132. Rotation of drive toggle 132 axially rotates drive rod 56, thereby co-rotating both leg rest drive link 74 and swing link 78. First pantograph linkage set 60 is not shown for clarity, however it is noted that rotation of both leg rest drive links 74, 74' and swing links 78, 78' act to extend first and second pantograph linkage sets 60, 62 to thereby extend the leg rest member. Because either first or second actuator device 28, 30 can be operated at any one time, or because both first and second actuator devices 28, 30 can be simultaneously operated, the occupant can choose either independent operation of the leg rest member or the seat back member, or simultaneous operation of both the leg rest member and seat back member. Any position of either the leg rest member 24 or the seat back member 16 can therefore be selected by the occupant independent of the other.

The tilt swing lever 137 is rotatably connected to the swing lever 134 using a tilt swing lever pin 144. Tilt swing lever pin 144 therefore displaces both the swing lever 134 and support rod 64 when tilt swing lever 137 is rotated. In the free position shown for tilt swing lever 137, tilt swing lever 137 is freely disposed on drive toggle connector extension rod 130 when the first and second pantograph linkage sets 60, 62 are substantially in their retracted positions. Limited extension of the first and second pantograph linkage sets 60, 62 can occur before drive toggle connector 128 contacts tilt swing lever 137. Continued contact between drive toggle connector 128 and tilt swing lever 137 will thereafter rotate tilt swing lever 137 and swing lever 134, and cause displacement of support rod 64, thereby creating the tilt position of mechanism 26. This will be shown and described in greater detail in reference to FIGS. 14-17.

Rotational bearings 146 are provided for each of the first and second arm brackets 108, 110 (only second arm bracket 110 is clearly visible in this view). The rotational bearings 146 permit the axial rotation of drive rod 56 with respect to drive rod axis of rotation 72 independent of the rotation of swing connection tube 100. This allows the rotational axis of swing connection tube 100 to also be maintained coaxial with respect to drive rod axis of rotation 72 without requiring co-rotation of swing connection tube 100 as drive rod 56 rotates.

Figure 7:
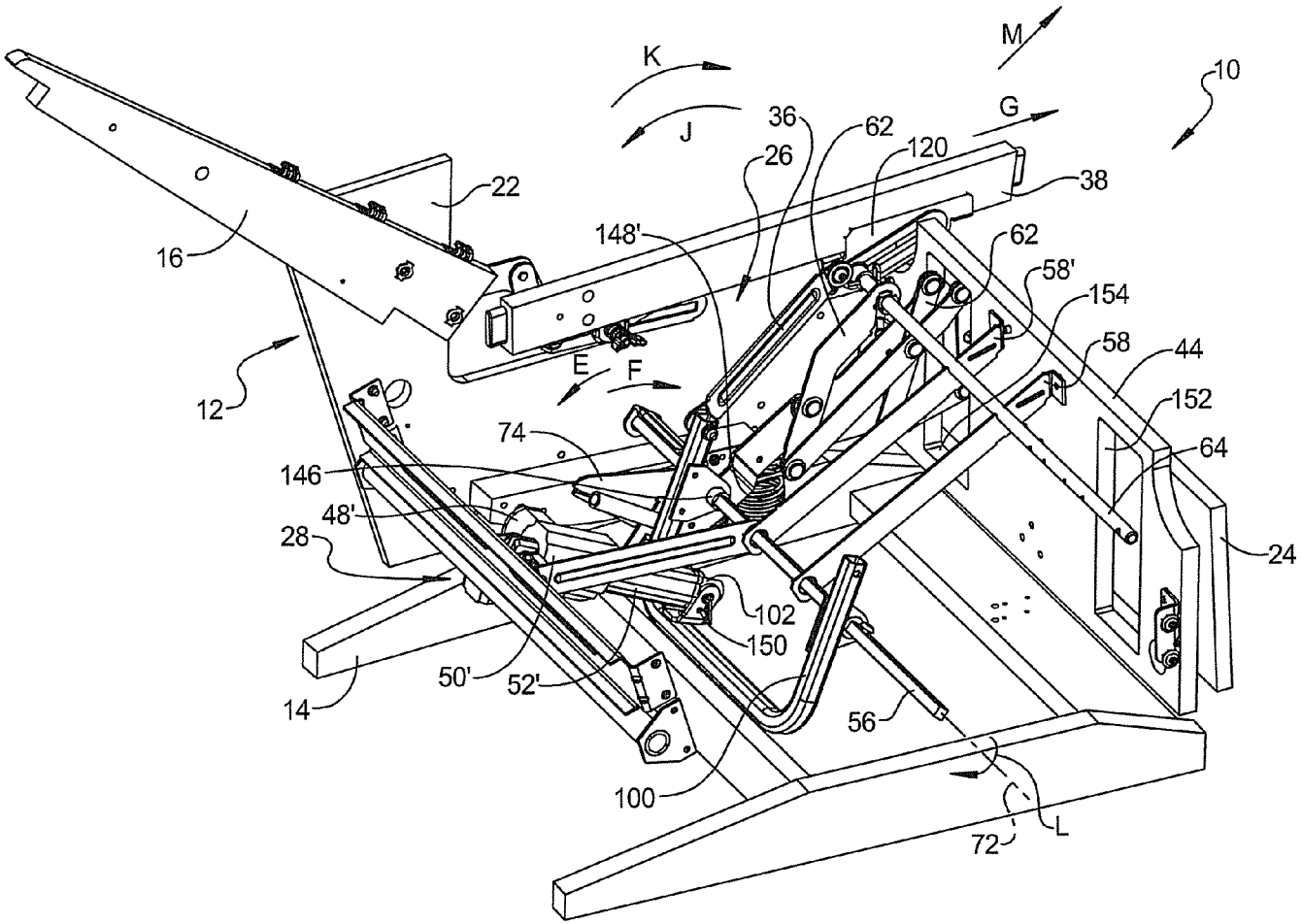
FIG. 7 is a right rear perspective view of a portion of the furniture member of FIG. 1 showing components operated to control seat back member rotation.

Referring to FIG. 7, in addition to the capability of mechanism 26 to provide for leg rest extension and retraction and seat back rotation, mechanism 26 further provides for a rocking motion of furniture frame assembly 12 with respect to base member 14 by manual force/weight distribution of the occupant of furniture member 10, as commonly known. This rotation or rocking motion of furniture frame assembly 12 can be controlled using an opposed set of rocker spring assemblies 148, 148' (only second rocker spring assembly 148' is clearly visible in this view). The rocker spring assemblies 148, 148' are connected to the first and second side members 20, 22 and to the base member 14. The axis of rotation for the rocking motion of furniture frame assembly 12 with respect to base member 14 is therefore determined by the position of the rocker spring assemblies 148, 148'. The rocking motion of furniture frame assembly 12 occurs with respect to a rearward rocking direction "J" and an opposite forward rocking direction "K". These rocking direction motions are independent of rear and forward rotation directions "E", "F" because the rear and forward rotation directions "E", "F" are oriented with respect to drive rod axis of rotation 72.

As further shown in FIG. 7, to return the seat back member 16 from the fully reclined to the upright position, first actuator device 28 is operated to retract first actuator extension shaft 102 with respect to actuator displacement member 52'. Because first actuator extension shaft 102 is rotatably connected to a first actuator connecting bracket 150, which is also connected to swing connection tube 100, this retraction of first actuator extension shaft 102 rotates swing connection tube 100 in a swing rotation direction "L" with respect to drive rod axis of rotation 72. Again and as previously noted, rotation of swing connection tube 100 in the swing rotation direction "L" does not result in an axial rotation of drive rod 56. Once the first actuator extension shaft 102 is fully retracted with respect to actuator displacement member 52', the weight of the occupant seated on furniture frame assembly 12 also assists in retracting lateral drive member 38 in a direction opposite to drive member powered motion direction "G", thereby permitting the rotation of seat back member 16 away from the fully retracted and back to the fully forward position. The weight of the occupant of furniture member 10, as well as any force provided by the occupant, therefore assists in the return of seat back member 16 to the upright position instead of this rotation being an entirely powered operation.

With the first and second pantograph linkage sets 60, 62 positioned in the fully retracted positions (only second pantograph linkage set 62 is clearly visible in this view), the first and second pantograph linkage sets 60, 62 are each received in an individual one of a first pantograph clearance aperture 152 or a second pantograph clearance aperture 154. The first and second pantograph clearance apertures 152, 154 are each created in the forward frame member 44. When leg rest member 24 is positioned in the stowed position, leg rest member 24 contacts forward frame member 44. The first and second pantograph clearance apertures 152, 154 permit a continuous connection between first and second pantograph linkage sets 60, 62 and leg rest member 24 through forward frame member 44 in any position of leg rest member 24.

Referring to FIG. 8, the leg rest drive link 74 is shown in the position corresponding to a fully retracted position of the first and second pantograph linkage sets 60, 62 (only first pantograph linkage set 60 is shown in this view). As drive rod 56 is axially rotated in the first drive rod rotation direction "H", leg rest drive link 74 is also co-rotated in the first drive rod rotation direction "H". The contact flange 80 of leg rest drive link 74 provides direct contact between leg rest drive link 74 and swing link 78 at an edge face 156 of swing link 78. This direct contact causes simultaneous rotation of swing link 78 as leg rest drive link 74 rotates in the first drive rod rotation direction "H". As previously noted, swing link 78 is freely rotationally positioned with respect to drive rod 56 and therefore does not directly rotate in response to rotation of drive rod 56. As swing link 78 is directed to rotate by contact flange 80, a rotational fastener 158 connecting swing link 78 to a link connecting end 160 of first pantograph linkage set 60 transfers the rotational motion of swing link 78 to a forward translation of link connecting end 160 and therefore to first pantograph linkage set 60.

Referring to FIG. 9 and again to FIG. 8, leg rest drive link 74 is shown following rotation of drive rod 56 in the first drive rod rotation direction "H", causing full extension of both first and second pantograph linkage sets 60, 62. At this time, leg rest drive link 74 is rotated greater than 90 degrees and approximately 110 degrees with respect to its orientation in the leg rest fully retracted position shown and described in FIG. 8. As previously noted, in addition to the support provided for the occupant's leg weight by swing links 78, 78', pantograph connecting links 84, 84' also distribute a portion of the occupant's leg weight to support rod 64. The first and second pantograph clearance apertures 152, 154, provided in forward frame member 44, provide clearance for maximum extension of first and second pantograph linkage sets 60, 62. Rotation of drive rod 56 in the first drive rod rotation direction "H" results from axial displacement in a substantially forward direction of second actuator extension shaft 126 which is displaced by operation of second actuator device 30. This displacement of second actuator extension shaft 126 causes rotation of drive toggle connector 128 and drive toggle 132, which is directly connected to drive rod 56. As previously noted, extension or retraction of first and second pantograph linkage sets 60, 62 occurs independently of any motion imparted by operation of first actuator device 28.

Referring to FIG. 10, a rotational pin 162 is provided to rotatably connect swing lever 134 to tilt swing lever 137. As previously noted, swing lever 134 is rotatably connected to support rod 64. The position shown for swing lever 134, with respect to drive toggle connector extension rod 130, permits free rotational displacement of swing lever 134 with respect to drive toggle connector extension rod 130. In this position, drive toggle connector 128 is spaced from swing lever 134, allowing free rotation of both swing lever 134 and tilt swing lever 137 without contact from and therefore in a non-powered manner with respect to drive toggle connector 128. The free rotation positions of swing lever 134 and tilt swing lever 137 also permit rocking motion of furniture member 10.

Referring to FIG. 11 and again to FIG. 10, swing lever 134 includes a pin aperture 164 which receives the rotational pin 162. Swing lever 134 also includes a bulbous end 166 having a curved end face 168. Curved end face 168 is generally convex in shape and is positioned during operation predominantly below drive toggle connector extension rod 130. In the free position of swing lever 134 wherein drive toggle connector 128 is not in contact with curved end face 168, the bulbous end 166 of swing lever 134 is free to displace in either of a first swing lever sliding direction "N" or an opposite second swing lever sliding direction "P" as swing lever 134 rotates with respect to support rod 64. This sliding motion in either of the first or second swing lever sliding directions "N", "P" permits rocking motion of furniture member 10 while maintaining drive toggle connector extension rod 130 sliding contact with swing lever 134 in all rotated positions of swing lever 134. Drive toggle connector extension rod 130 acts as a guide to maintain swing lever 134 in a position for curved end face 168 to be contacted by drive toggle connector 128, shown and described in better detail in reference to FIGS. 16 and 17, for powered rotation of swing lever 134.

Referring to FIG. 12 and again to FIGS. 10-11, swing lever 134 includes a rod clearance aperture 170 to allow the free sliding motion of drive toggle connector extension rod 130 with respect to swing lever 134 as swing lever 134 rotates. A longitudinal cavity 171 is also provided in tilt swing lever 137, which receives bulbous end 166 of swing lever 134, to provide further support and sliding guidance for relative displacement between bulbous end 166 and tilt swing lever 137. This maintains alignment between swing lever 134 and tilt swing lever 137 during rotation.

Figure 12:
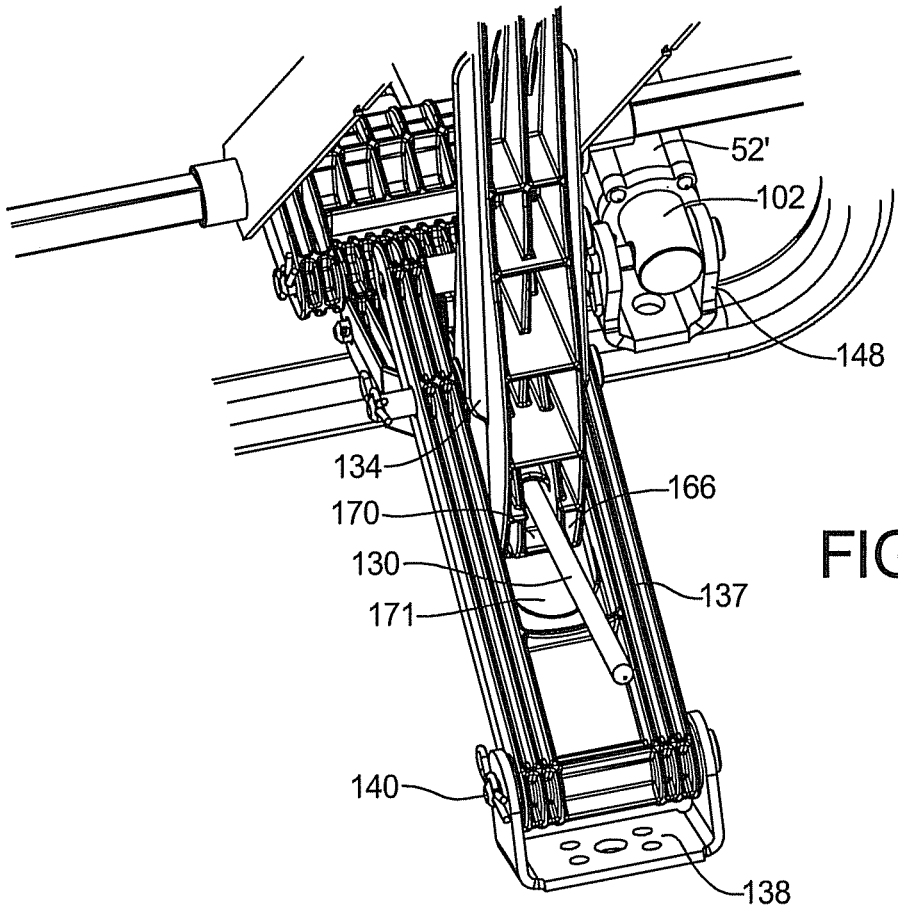
FIG. 12 is a front right perspective view of a swing lever and tilt swing lever combination of the mechanism of FIG. 6.
Figure 13:
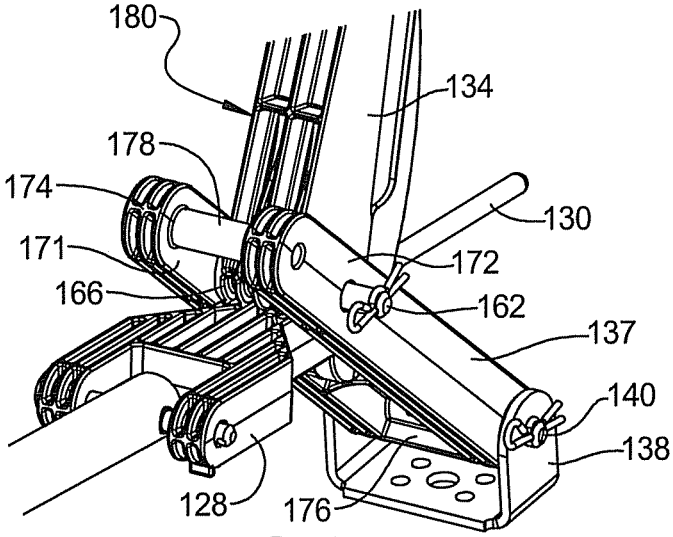
FIG. 13 is a right rear perspective view of the swing lever and tilt swing lever combination of FIG. 12.

Referring to FIG. 13 and again to FIG. 12, according to several embodiments tilt swing lever 137 has a substantially U-shape and includes opposed first and second lever arms 172, 174. Longitudinal cavity 171 is created between first and second lever arms 172, 174. The first and second lever arms 172, 174 are both fixedly connected to a lever connecting member 176. The tilt swing rotation pin 140 is slidably received through lever connecting member 176. In addition to lever connecting member 176, tilt swing lever 137 further includes a lever post 178 which spans opposite ends of first and second lever arms 172, 174 with respect to the location of lever connecting member 176. Lever post 178 creates a positive point of contact when contacting a swing lever face 180 of swing lever 134 to establish a maximum rotated position of tilt swing lever 137 and swing lever 134.

Figure 14:
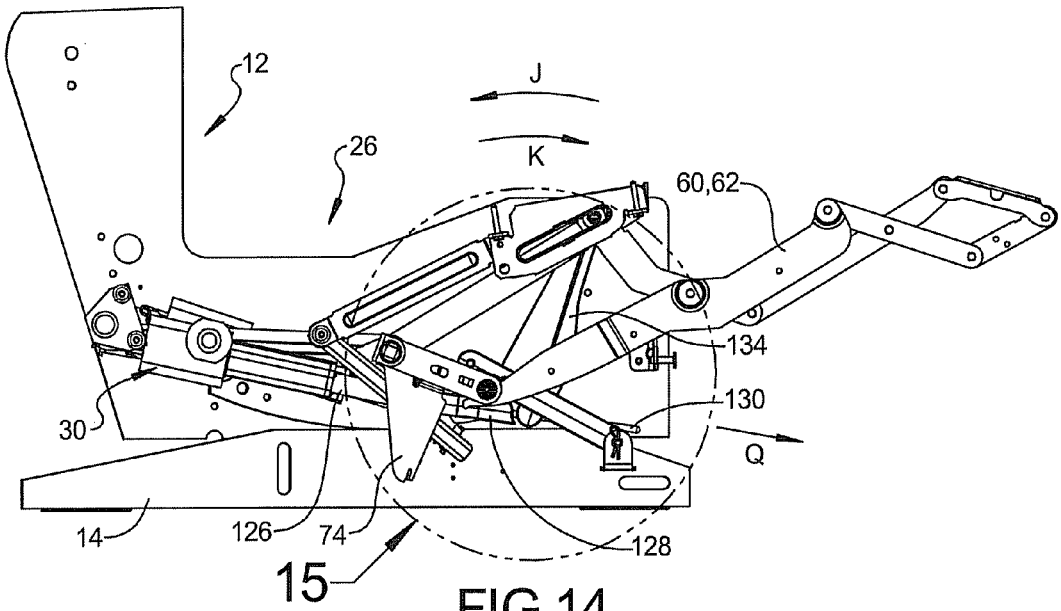
FIG. 14 is a right side elevational view of the furniture member of FIG. 2 having a furniture member right side member removed for clarity.

Referring to FIG. 14, mechanism 26 is shown at the fully extended position of first and second pantograph linkage sets 60, 62 and also at the point of contact between drive toggle connector 128 and swing lever 134. To reach this position, second actuator device 30 is operated, thereby axially extending second actuator extension shaft 126 in an extension shaft direction of extension "Q". Up until the point of contact is reached between drive toggle connector 128 and swing lever 134, the furniture frame assembly 12 is free to rock in either of the rearward or forward rocking directions "J", "K" with respect to base member 14. Immediately upon contact between drive toggle connector 128 and swing lever 134, further free rocking motion of furniture frame assembly 12 is precluded.

Referring to FIG. 15 and again to FIG. 14, second actuator extension shaft 126 is rotatably connected to drive toggle connector 128 using a pinned connection through a clevis 182. Drive toggle connector 128 is fixedly connected to drive toggle connector extension rod 130, therefore extension of second actuator extension shaft 126 co-extensively displaces each of drive toggle connector 128 and drive toggle connector extension rod 130. As this displacement occurs, the curved end face 168 of drive toggle connector 128 is brought into direct contact with swing lever 134. Further subsequent extension of second actuator extension shaft 126 in extension shaft direction of extension "Q" causes a combined and oppositely directed rotation of swing lever 134 which rotates with respect to support rod 64, and tilt swing lever 137 which rotates with respect to tilt swing rotation pin 140. The axis of common rotation between swing lever 134 and tilt swing lever 137 is with respect to rotational pin 162.

Figure 15:
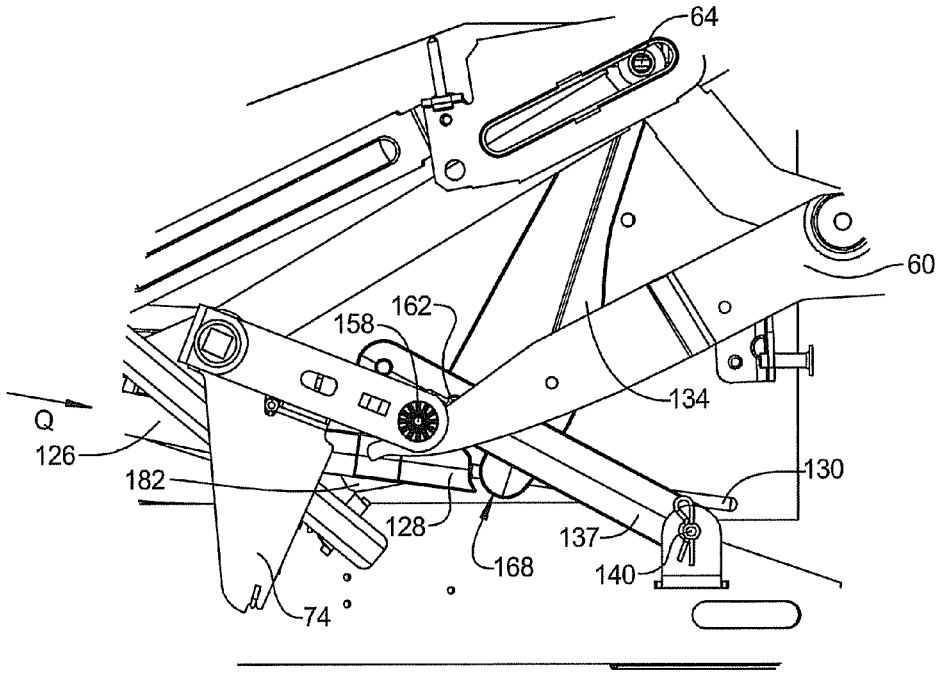
FIG. 15 is a right side elevational view of area 15 of FIG. 14.

Referring to FIG. 16 and again to FIG. 15, during extension of second actuator extension shaft 126 in the extension shaft direction of extension "Q" curved end face 168 of bulbous end 166 contacts a second curved end face 184 of drive toggle connector 128. Because tilt swing lever 137 is rotatably connected using tilt swing rotation pin 140 to tilt swing mount bracket 138, and tilt swing mount bracket 138 is fixedly connected to base member 14, a clockwise rotation of tilt swing lever 137 causes a corresponding counterclockwise rotation of swing lever 134 as viewed in FIG. 16 with respect to the axis of rotational pin 162. As tilt swing lever 137 rotates in the clockwise rotation direction, the tilt swing lever 137 approaches but does not reach co-axial alignment with a longitudinal axis of swing lever 134. This results in a net displacement in a tilt direction "Z" of support rod 64 because of the connection between swing lever rotation end 136 and support rod 64. Displacement in tilt direction "Z" of support rod 64 therefore provides a forward and upward motion of the front corner 68 of furniture frame assembly 12 and a rearward rotational lowering of the frame assembly rear corner 70 as shown and described in reference to FIG. 3. The weight of the occupant is therefore partially supported in the tilt position by swing lever 134, tilt swing lever 137, and rotational pin 162. Because the leg rest assembly can be in its fully extended position during this tilt motion, the leg rest member 24 is further elevated with respect to a floor or planar surface upon which base member 14 is supported.

Figure 16:
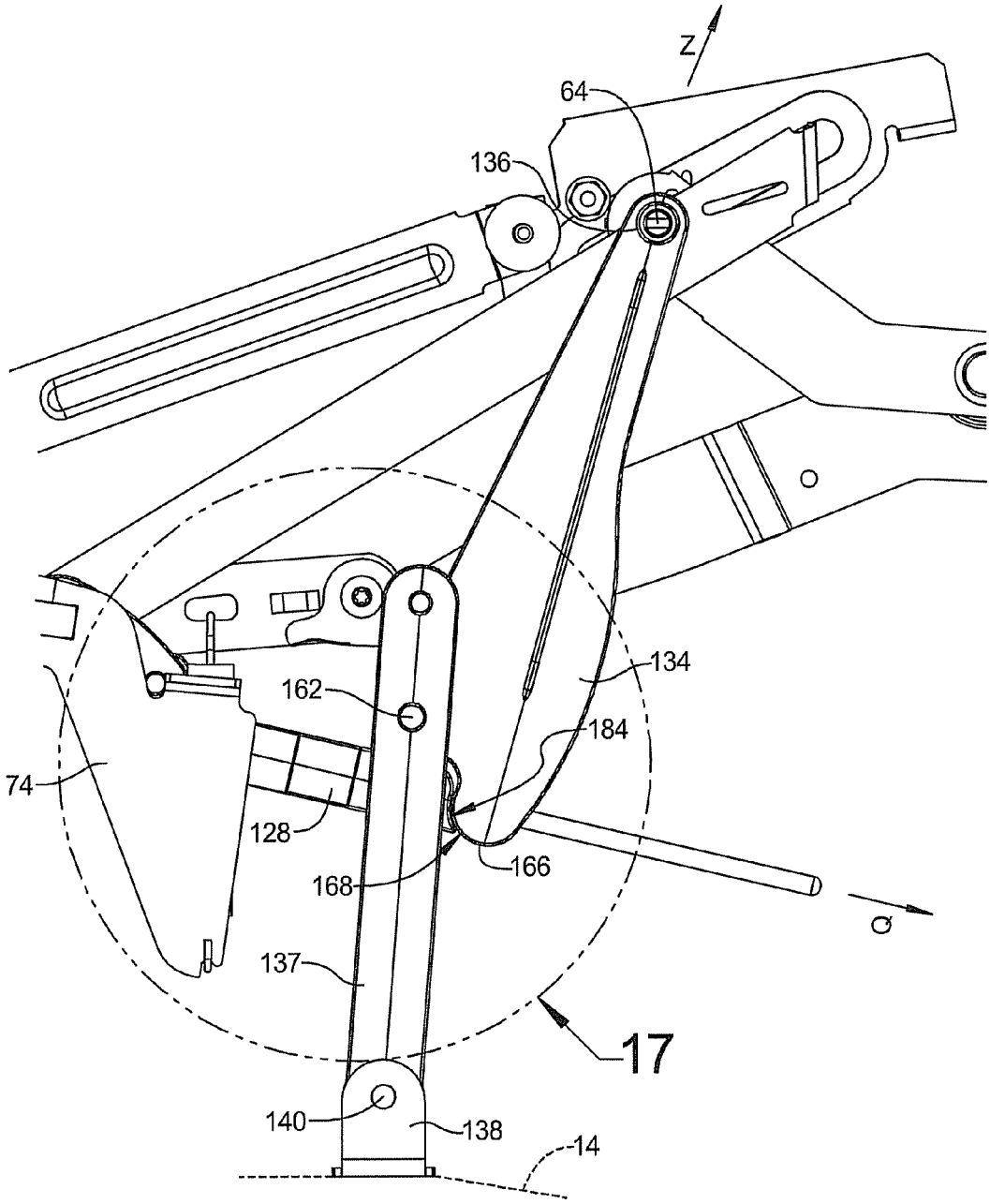
FIG. 16 is a right side elevational view modified from FIG. 10 to shown the mechanism in a leg rest extended and full rearward tilt position.
Figure 17:
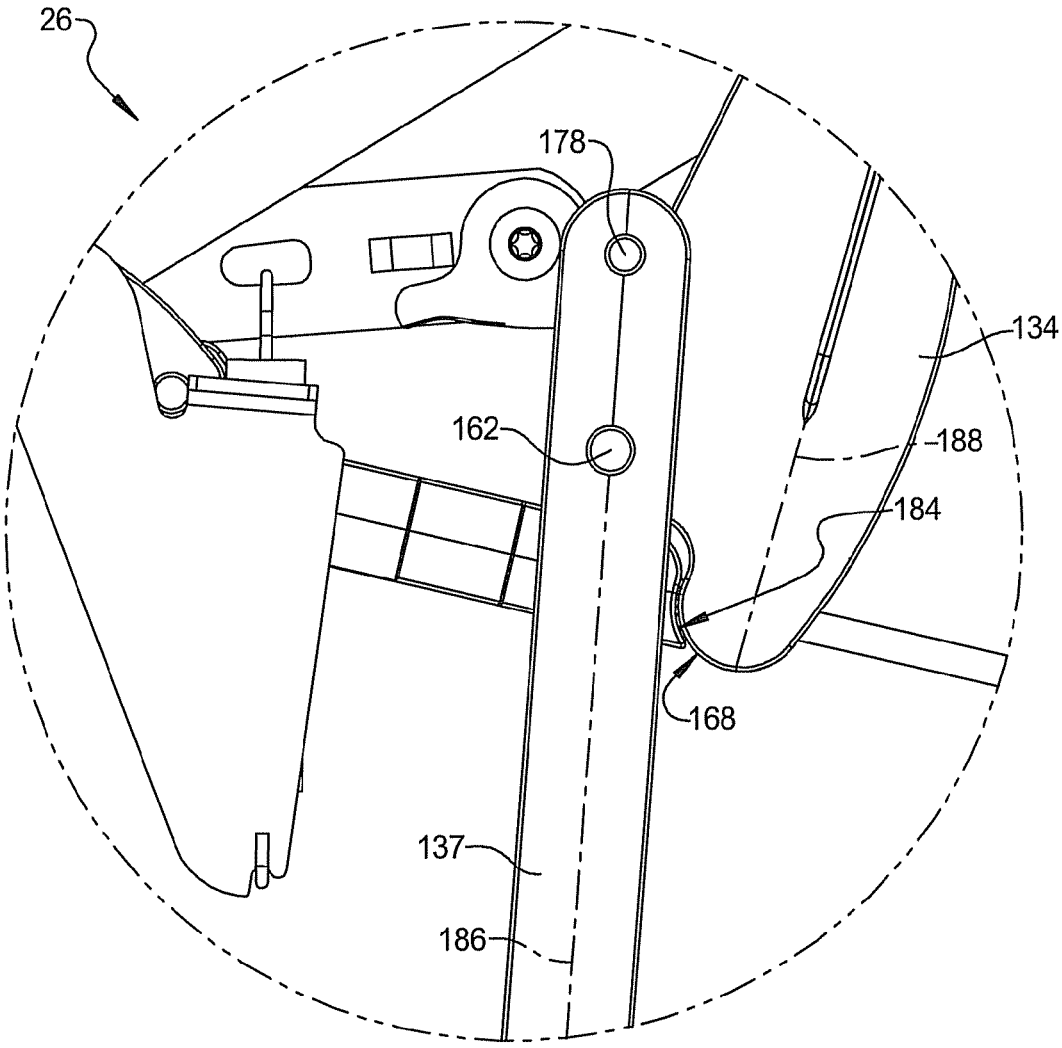
FIG. 17 is a right side elevational view of area 17 of FIG. 16.

Referring to FIG. 17 and again to FIG. 16, to reduce friction between curved end face 168 and second curved end face 184 during rotation, these two curved surfaces share a substantially corresponding geometry. At the tilt position of mechanism 26, a tilt swing lever longitudinal axis 186 is closely but not co-axially aligned with respect to a swing lever longitudinal axis 188 to prevent reaching a locking or over-center position of swing lever longitudinal axis 188.

Figure 18:
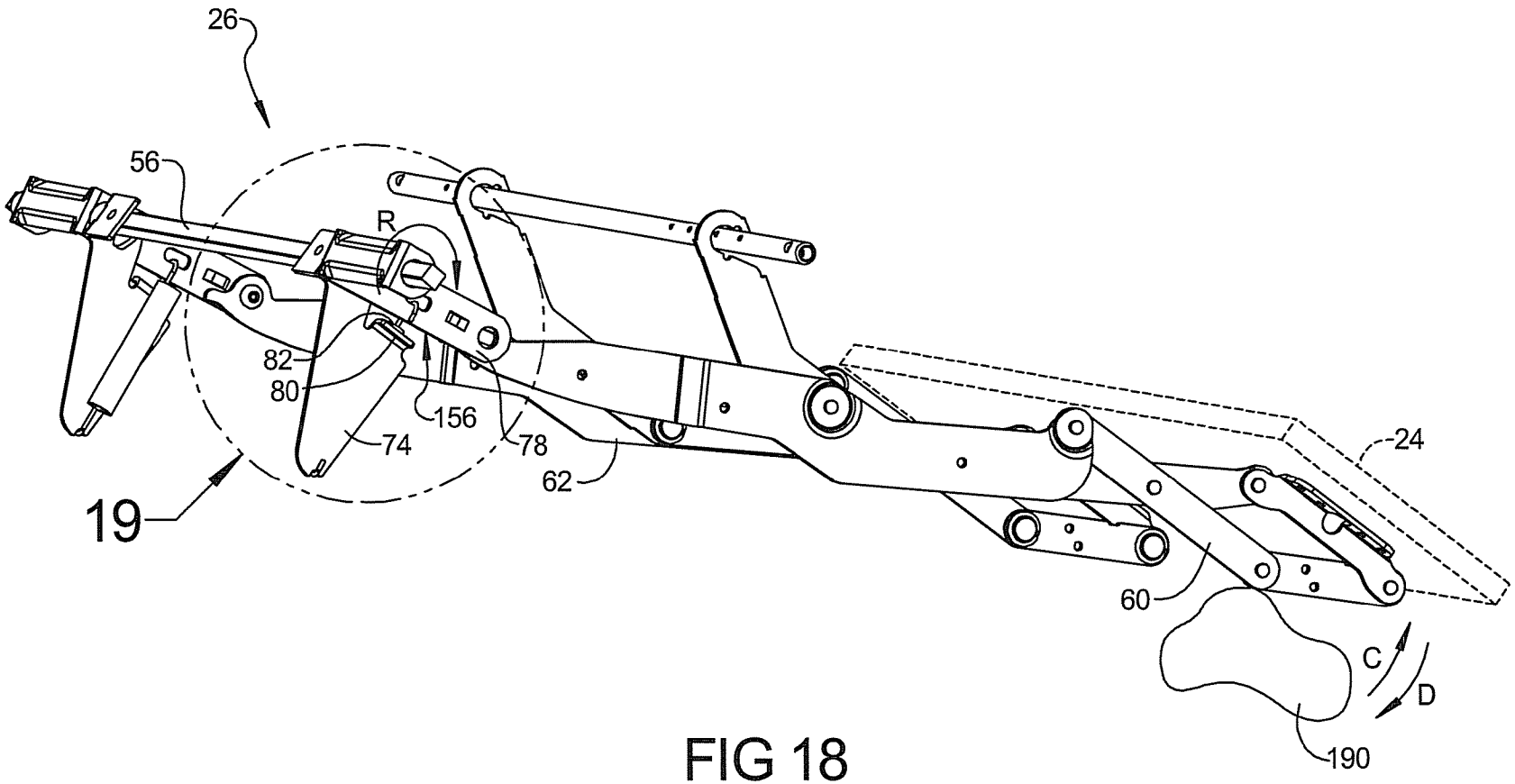
FIG. 18 is a right rear perspective view of the fully extended position of the pantograph linkage set in a object contact/release position.

Referring to FIG. 18, mechanism 26 is also provided with a release capability such that if an object 190 is encountered by either the leg rest member 24 or either of the first or second pantograph linkage sets 60, 62 when the leg rest member 24 is returned in the leg rest retraction direction "D", swing link 78 will release from its contact position with leg rest drive link 74. Drive rod 56 will continue its axial rotation with respect to a second drive rod rotation direction "R" together with leg rest drive link 74 while swing link 78 rotatably separates with respect to contact flange 80 of leg rest drive link 74. This permits the leg rest member 24 and each of the first and second pantograph linkage sets 60, 62 to remain substantially in the extended or partially extended position and in contact with the object 190 as the powered operation or rotation of drive rod 56 continues. After swing link 78 releases from leg rest drive link 74, only the biasing force of biasing member 82 acts to retract leg rest member 24. This permits the subsequent lifting of leg rest member 24 by manual displacement in the leg rest extension direction "C" to remove object 190 although the leg rest drive link 74 may have continued its further rotation due to rotation of drive rod 56.

Figure 19:
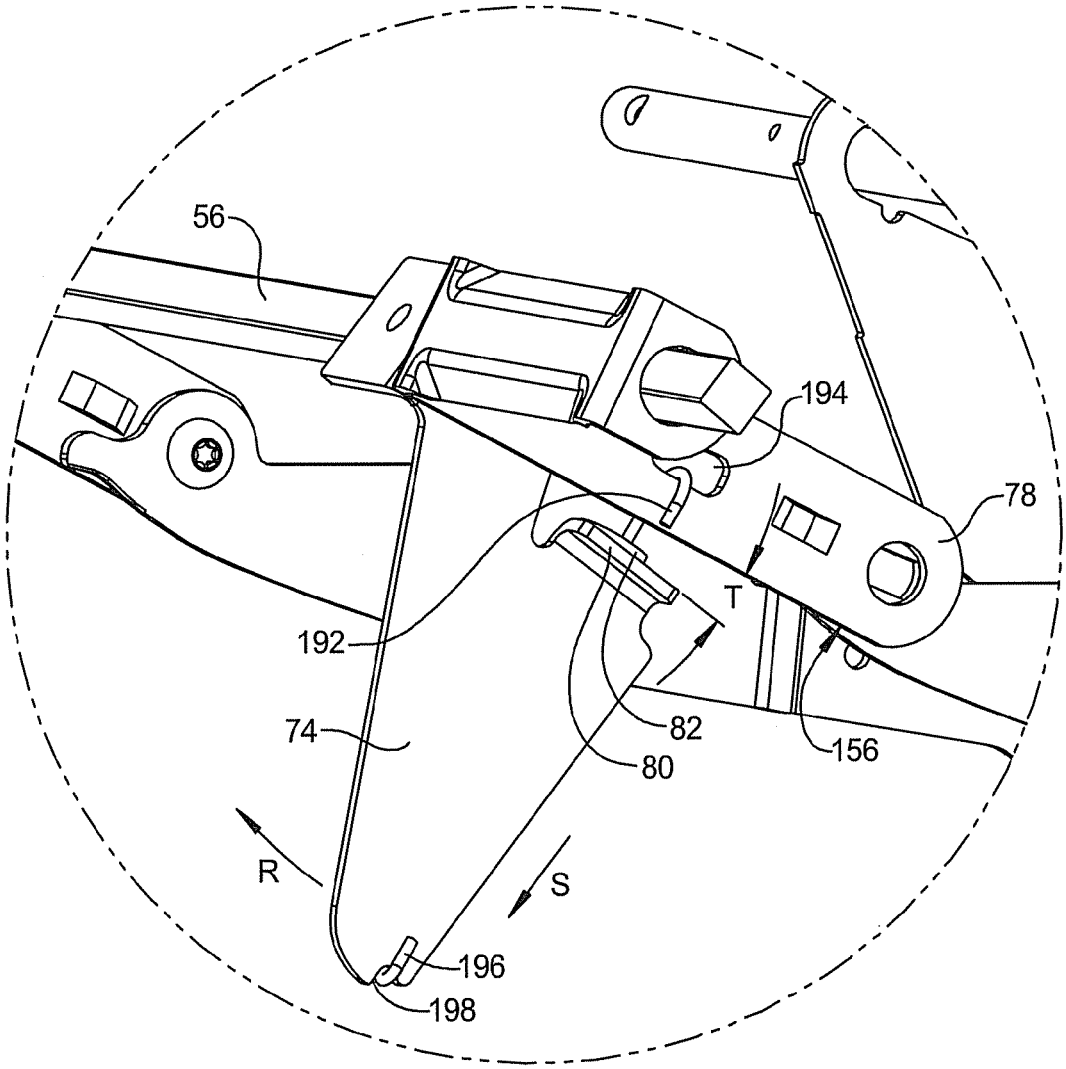
FIG. 19 is a right rear perspective view of area 19 of FIG. 18.

Referring to FIG. 19, to provide for the release capability of leg rest member 24 with respect to leg rest drive link 74, biasing member 82 is provided with a biasing member first hook end 192 which is received in an elongated slot 194 created in swing link 78. An opposite biasing member second hook end 196 is engaged in a link slot 198 created in leg rest drive link 74. A biasing force of biasing member 82 acts in a biasing force direction "S". With continuing reference to FIGS. 18 and 19, as the object 190 is encountered by leg rest member 24 or either of the first or second pantograph linkage sets 60, 62, a gap "T" is created between contact flange 80 and edge face 156 of swing link 78. The distance of gap "T" can vary with the amount of continued rotation of leg rest drive link 74 in the second drive rod rotation direction "R".

With continuing reference to FIG. 18 and FIG. 1, because axial rotation of drive rod 56 is controlled by the occupant of furniture member 10 using second actuator device 30, axial rotation of drive rod 56 can be stopped as soon as the occupant becomes aware of contact with the object 190. Once the object 190 has been cleared, the first and second pantograph linkage sets 60, 62 will return by gravity until the edge face 156 of swing link 78 once again contacts contact flange 80 of leg rest drive link 74. This contact will occur at the rotated position reached for leg rest drive link 74. The leg rest member 24 can therefore return to its fully retracted or stowed position or be retained in a partially extended position depending on where the rotation of leg rest drive link 74 was stopped. According to several embodiments, biasing member

82 can be a compression spring made from spring steel having the biasing force predetermined to ensure the full return of leg rest member 24 to the fully stowed position should leg rest drive link 74 be fully rotated to the position shown and described with reference to FIG. 8.

With continued reference to FIGS. 1-19, furniture member mechanism 26 for power combined and independent seat back and leg rest motion includes first actuator device 28 electrically operated to displace first and second seat back actuation links 35, 36 which are connected to and operate to rotate seat back member 16 between an upright position (FIG. 2) and a fully reclined position (FIG. 3). Pantograph linkage set 60, 62 is connected to leg rest member 24. The pantograph linkage set 60, 62 is at least partially supported in an extended position by rotational contact with support rod 64. Second actuator device 30 is identical to the first actuator device 28 and is electrically operated to axially rotate drive rod 56 connected to at least one leg rest drive link 74, 74'. The leg rest drive link 74, 74' is connected to and displaces the pantograph linkage set 60, 62 between stowed (FIG. 1) and extended (FIG. 2) positions. The swing lever 134 is rotatably connected to the support rod 64 and rotated during operation of the second actuator device 30 to extend the pantograph linkage set 60, 62. The swing lever 134 in a fully rotated position displaces the support rod 64 thereby creating a furniture member tilt position (FIG. 3).

Mechanisms 26 of the present disclosure offer several advantages. By separating the action of rotating seat back member 16 from the action of extending leg rest member 24 through the use of independently operated first and second actuator devices 28, 30, seat back member 16 can be moved independently with respect to leg rest member 24. By further including a tilt control for furniture member 10 with the second actuator device 30, automatic tilt is provided when leg rest member 24 is extended. The provision of first and second actuator devices 28, 30 with the added capability of furniture member 10 to rock provides full rocking, seat back rotation, and independent leg rest extension operations in a single mechanism.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member mechanism for power combined and independent seat back and leg rest motion, comprising:

a first actuator device connected to and electrically operated to displace a seat back member between an upright position and a fully reclined position; and a second actuator device connected to and electrically operated to displace a leg rest member between a stowed and a fully extended position;

a drive rod axially rotated by the second actuation device to extend or retract the leg rest member;

a swing connection tube freely rotatably connected to the drive rod such that axial rotation of the drive rod does not rotate the swing connection tube;

first and second seat back actuation links connected to the swing connection tube, the first and second seat back actuation links connected to the seat back member such that displacement of the first and second seat back actuation links by rotation of the swing connection tube rotates the seat back member; and the mechanism selectively operated either having one of the first and second actuator devices energized while the other one of the first and second actuator devices is de-energized, or having both the first and second actuator devices energized simultaneously.

2. The furniture member mechanism for power combined and independent seat back and leg rest motion of claim 1, wherein the drive rod is connected to the second actuation device to extend or retract the leg rest member, wherein operation of the first actuation device does not axially rotate the drive rod.

3. A furniture member mechanism for power combined and independent seat back and leg rest motion, comprising:

a first actuator device connected to and electrically operated to displace a seat back member between an upright position and a fully reclined position;

a second actuator device connected to and electrically operated to displace a leg rest member between a stowed and a fully extended position;

the mechanism selectively operated either having one of the first and second actuator devices energized while the other one of the first and second actuator devices is de-energized, or having both the first and second actuator devices energized simultaneously;

a drive rod connected to and axially rotated by operation of the second actuation device to extend or retract the leg rest member, wherein operation of the first actuation device does not axially rotate the drive rod;

first and second leg rest drive links connected to the drive rod and co-rotated by rotation of the drive rod during operation of the second actuator device; and first and second swing links freely connected to the leg rest member and rotatably connected to the drive rod, the first and second swing links rotated by the first and second leg rest drive links only in a first drive rod rotation direction.

4. The furniture member mechanism for power combined and independent seat back and leg rest motion of claim 3, further including a contact flange extending from the first and second leg rest drive links individually directly contacting one of the first or second swing links acting to rotate the first and second swing links together with the first and second leg rest drive links when the drive rod is rotated in the first drive rod rotation direction; wherein contact by the leg rest member with an object during return of the leg rest member from the fully extended to the stowed position creates a gap between the first and second swing links and the contact flange of the first and second leg rest drive links permitting continued powered retraction of the first and second leg rest drive links without retraction of the leg rest member.

5. The furniture member mechanism for power combined and independent seat back and leg rest motion of claim 1, further including:

an actuator extension shaft connected to and axially displaced by operation of the second actuator device;

a drive toggle connector connected to the actuator extension shaft having an extension rod;

a support rod connected to a furniture frame assembly; and a swing lever rotatably connected to the support rod and freely displaceable on the extension rod.

6. The furniture member mechanism for power combined and independent seat back and leg rest motion of claim 5, further including a tilt swing lever rotatably connected to a base member of the furniture member and rotatably connected to the swing lever, wherein direct contact by the drive toggle connector and the swing lever causes opposite rotations of the swing lever and the tilt swing lever until substantial co-linear alignment of the tilt swing lever and the swing lever displace the support rod thereby rotating the furniture member frame assembly to a tilt position.

7. The furniture member mechanism for power combined and independent seat back and leg rest motion of claim 6, wherein extension of the leg rest member and rotation of the furniture member frame assembly to the tilt position occur simultaneously during operation of the second actuator device.

8. The furniture member mechanism for power combined and independent seat back and leg rest motion of claim 1, further including:

first and second seat back actuation links connected to the first actuator device; and first and second mount plates individually connected to one of the first and second seat back actuation links, the first mount plate connected to a lateral drive member operating to rotate the seat back member.

9. The furniture member mechanism for power combined and independent seat back and leg rest motion of claim 1, further including:

the swing connection tube defining a substantially U-shape having first and second tube arms each rotatably connected to one of the first or second seat back actuation links.

10. The furniture member mechanism for power combined and independent seat back and leg rest motion of claim 1, further including:

a first actuator connection bracket rotatably connecting the first actuator to the swing connection tube.

11. The furniture member mechanism for power combined and independent seat back and leg rest motion of claim 1, further including:

a first biasing member connecting a first leg rest drive link to a first swing link; and a second biasing member connecting a second leg rest drive link to a second swing link;

wherein the first and second swing links are connected to the leg rest member and contact of the leg rest member with an object during return of the leg rest member from the fully extended to the stowed position creates a gap between the first and second swing links and a contact flange of the first and second leg rest drive links and extension of the first and second biasing members, a biasing force of the first and second biasing members thereafter acting to return the first and second swing links into contact with the contact flanges of the first and second leg rest drive links following removal of the object.

12. The furniture member mechanism for power combined and independent seat back and leg rest motion of claim 1, wherein the first and second actuator devices each include a 24 volt DC current motor and an actuator drive member operating to transfer motor rotation to a linear drive direction.

13. A furniture member mechanism for power combined and independent seat back and leg rest motion, comprising:

a first actuator device electrically operated to displace first and second seat back actuation links connected to and operating to rotate a seat back member between an upright position and a fully reclined position; and a second actuator device electrically operated to rotate at least one drive link connected to and displacing a leg rest member between a stowed and a fully extended position;

an actuator extension shaft extended or retracted by operation of the second actuator device, the actuator extension shaft rotatably connected to a drive toggle connector;

a drive rod; and a drive toggle connected to drive rod and rotatably connected to the drive toggle connector, the drive toggle axially rotating the drive rod when rotated by the drive toggle connector;

the mechanism selectively operated having one of the first and second actuator devices energized while the other one of the first and second actuator devices is de-energized, or having both the first and second actuator devices energized simultaneously.

14. The furniture member mechanism for power combined and independent seat back and leg rest motion of claim 13, further including:

a U-shaped swing connection tube having opposed first and second tube arms each rotatably connected to one of the first and second seat back actuation links; and the first actuator extension shaft rotatably connected to the swing connection tube such that extension of the first actuator extension shaft rotates the swing connection tube.

15. The furniture member mechanism for power combined and independent seat back and leg rest motion of claim 14, further including a rod freely rotatably supporting both the first and second tube arms of the swing connection tube, the rod axially rotated by operation of the second actuation device to extend the leg rest member without rotation of the swing connection tube.

16. A furniture member mechanism for power combined and independent seat back and leg rest motion, comprising:

a first actuator device electrically operated to displace first and second seat back actuation links connected to and operating to rotate a seat back member between an upright position and a fully reclined position;

a second actuator device electrically operated to rotate at least one drive link connected to and displacing a leg rest member between a stowed and a fully extended position;

a pantograph linkage set connected to the leg rest member;

a leg rest drive link connected to a drive rod for co-rotation during axial rotation of the drive rod, and having a contact flange;

a swing link freely rotatably supported by the drive rod and connected to the pantograph linkage set, the swing link directly contacted by the contact flange to co-rotate the swing link together with the leg rest drive link only in a first drive rod rotation direction to extend the pantograph linkage set; and the mechanism selectively operated having one of the first and second actuator devices energized while the other one of the first and second actuator devices is de-energized, or having both the first and second actuator devices energized simultaneously.

17. A furniture member mechanism for power combined and independent seat back and leg rest motion, comprising:

a first actuator device electrically operated to displace first and second seat back actuation links connected to and operating to rotate a seat back member between an upright position and a fully reclined position;

a pantograph linkage set connected to a leg rest member, the pantograph linkage set at least partially supported in an extended position by rotational contact with a support rod;

a second actuator device identical to the first actuator device and electrically operated to axially rotate a drive rod connected to at least one drive link, the drive link connected to and displacing the pantograph linkage set between a stowed and the extended positions;

a swing lever rotatably connected to the support rod and rotated during operation of the second actuator device to extend the pantograph linkage set, the swing lever in a fully rotated position displacing the support rod creating a furniture member tilt position;

a bulbous end of the swing lever having a first curved end face defining a convex shape; and a drive toggle connector connected to the second actuator device, the drive toggle connector including a second curved end face having a geometry defining a concave shape, the concave shape corresponding to convex shape such that a longitudinal displacement of the drive toggle connector causes rotation of the swing lever where the first and second curved end faces contact each other.

18. The furniture member mechanism for power combined and independent seat back and leg rest motion of claim 17, further including:

a drive toggle connector connected to the second actuator device; and a drive toggle connected to and co-rotatable with the drive rod and rotatably connected to the drive toggle connector, rotation of the drive toggle connector acting to rotate the drive toggle and thereby to axially rotate the drive rod.

19. The furniture member mechanism for power combined and independent seat back and leg rest motion of claim 18, further including an actuator extension shaft extended or retracted by operation of the second actuator device, the actuator extension shaft rotatably connected to the drive toggle connector.

20. The furniture member mechanism for power combined and independent seat back and leg rest motion of claim 17, wherein the mechanism is selectively operated in either a first or second mode, the first mode having one of the first and second actuator devices energized while the other one of the first and second actuator devices is de-energized, and the second mode having both the first and second actuator devices energized simultaneously.

21. The furniture member mechanism for power combined and independent seat back and leg rest motion of claim 17, further including a tilt swing lever rotatably connected to the swing lever and to a base member of the furniture member, an axis of the tilt swing lever substantially aligned with an axis of the swing lever in the fully rotated position.

22. The furniture member mechanism for power combined and independent seat back and leg rest motion of claim 17, further including:

an extension rod freely extending from the drive toggle connector; and a rod clearance aperture created proximate the bulbous end of the swing lever, the extension rod slidably extending through the rod clearance aperture to maintain the first curved end face of the swing lever in alignment with the second curved end face of the drive toggle connector prior to contact between the first and second curved end faces.

23. A furniture member, comprising:

a furniture frame assembly rotatably connected to a base member;

a rocker spring assembly connected to each of the furniture frame assembly and the base member permitting a rocking motion of the furniture frame assembly with respect to the base member; and a mechanism, including:

a first actuator device electrically operated to displace first and second seat back actuation links connected to and operating to rotate a seat back member between an upright position and a fully reclined position;

a pantograph linkage set connected to a leg rest member, the pantograph linkage set at least partially supported in an extended position by rotational contact with a support rod, the support rod connected to opposite first and second side members of the furniture frame assembly;

a second actuator device identical to the first actuator device and electrically operated to axially rotate a drive rod connected to at least one drive link, the drive link connected to and displacing the pantograph linkage set between a stowed and the extended positions;

a drive toggle connector connected to the second actuator device; and a drive toggle connected to and co-rotatable with the drive rod and rotatably connected to the drive toggle connector, rotation of the drive toggle connector acting to rotate the drive toggle and thereby to axially rotate the drive rod.

24. The furniture member of claim 23, further including a swing lever rotatably connected to the support rod and rotated during operation of the second actuator device to extend the pantograph linkage set, the swing lever in a fully rotated position displacing the support rod lifting a front corner of the furniture frame assembly with respect to a rear corner of the furniture frame assembly creating a furniture frame assembly tilt position.

25. The furniture member of claim 24, further including:

a bulbous end of the swing lever having a first curved end face defining a convex shape; and a drive toggle connector connected to the second actuator device, the drive toggle connector including a second curved end face having a geometry defining a concave shape, the concave shape corresponding to convex shape such that a longitudinal displacement of the drive toggle connector causes rotation of the swing lever where the first and second curved end faces contact each other.

26. The furniture member of claim 25, further including:

an extension rod freely extending from the drive toggle connector; and a rod clearance aperture created proximate the bulbous end of the swing lever, the extension rod slidably extending through the rod clearance aperture to maintain the first curved end face of the swing lever in alignment with the second curved end face of the drive toggle connector prior to contact between the first and second curved end faces, wherein contact between the first and second curved end faces thereafter precludes the rocking motion of the furniture frame assembly.

27. The furniture member of claim 24, further including a tilt swing lever rotatably connected to each of the swing lever and the base member, an axis of the tilt swing lever substantially aligned with an axis of the swing lever in the fully rotated position.

28. The furniture member of claim 23, further including an actuator extension shaft extended or retracted by operation of the second actuator device, the actuator extension shaft rotatably connected to the drive toggle connector.

29. The furniture member of claim 23, wherein the mechanism is selectively operated in either a first or a second mode, the first mode having one of the first and second actuator devices energized while the other one of the first and second actuator devices is de-energized, and the second mode having both the first and second actuator devices energized simultaneously.

* * * * *